US006481976B2

(12) United States Patent
Kimura et al.

(10) Patent No.: US 6,481,976 B2
(45) Date of Patent: Nov. 19, 2002

(54) CONTROL VALVE AND VARIABLE CAPACITY TYPE COMPRESSOR HAVING CONTROL VALVE

(75) Inventors: Kazuya Kimura, Kariya (JP); Masahiro Kawaguchi, Kariya (JP); Hiroaki Kayukawa, Kariya (JP); Tetsuhiko Fukanuma, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 20 days.

(21) Appl. No.: 09/731,607

(22) Filed: Dec. 7, 2000

(65) Prior Publication Data

US 2001/0003573 A1 Jun. 14, 2001

(30) Foreign Application Priority Data

Dec. 9, 1999 (JP) ..... 11-350152

(51) Int. Cl.[7] ..... F04B 1/26

(52) U.S. Cl. ..... 417/222.2; 417/199.1; 417/222.1; 417/269; 417/295; 137/454.6; 251/61.5

(58) Field of Search ..... 92/12.2, 71; 251/61.5, 251/129.02, 129.13, 129.15, 129.18; 137/454.6, 596.17, 625.65, 870; 417/199.1, 213, 218, 219, 222.1, 222.2, 269, 295, 270, 310, 313, 454

(56) References Cited

U.S. PATENT DOCUMENTS 2,633,871 A * 4/1953 Parsons ..... 137/106
2,704,649 A * 3/1955 Ellenberger ..... 137/630.13
3,012,578 A * 12/1961 Ludwig ..... 137/596.17
4,623,118 A * 11/1986 Kumar ..... 251/129.15
4,729,718 A * 3/1988 Ohta et al. ..... 417/270
4,946,350 A * 8/1990 Suzuki et al. ..... 417/270
5,173,032 A * 12/1992 Taguchi et al. ..... 417/222.2
6,033,189 A * 3/2000 Miura et al. ..... 417/222.2
6,102,670 A * 8/2000 Taguchi ..... 417/222.2

FOREIGN PATENT DOCUMENTS

JP 11-82300 3/1999

OTHER PUBLICATIONS

Denso (Malaysia) SDN BHD, 2001, Denso, Compressor, page 1.*

* cited by examiner

*Primary Examiner*—Charles G. Freay
(74) *Attorney, Agent, or Firm*—Woodcock Washburn LLP

(57) ABSTRACT

A variable capacity type compressor has a tiltable swash plate and pistons. A control valve is arranged to change the pressure in the crank chamber, to vary the capacity of the compressor by changing the inclination angle of the swash plate by changing the pressure in the crank chamber. The control valve has independently movable first and second plungers and a coil arranged around the first and second plungers so that the coil generates an electromagnetic attraction force acting on and between the first and second plungers. First and second valve elements provided on the first and second plungers can adjust the degree of opening of the first and second fluid passages.

21 Claims, 9 Drawing Sheets

CONTROL VALVE AND VARIABLE CAPACITY TYPE COMPRESSOR HAVING CONTROL VALVE

BACKGROUND OF THE INVENTION

1. Field of the Invention

The present invention relates to a control valve, used for a variable capacity type compressor constituting a refrigerant circulating circuit of a vehicle air conditioner to compress refrigerant gas and also to a variable capacity compressor having such a control valve.

2. Description of the Related Art

As this type of variable capacity compressor, for example, a swash plate type variable capacity type compressor is known and is shown in FIG. 9. In the variable capacity type compressor, which will be simply referred to as a compressor in this specification hereinafter, when the swash plate 101 is rotated, the pistons 102 are reciprocated, so that refrigerant gas is compressed, and the discharge capacity can be adjusted when the pressure in the crank chamber 103 is adjusted. In this case, the swash plate 101 is driven by an engine of a vehicle, which is an external drive source.

In order to adjust the pressure in the crank chamber 103, there are provided an extraction gas passage 105 having a fixed restriction 105*a* connecting the crank chamber 103 to the suction chamber 104, a supply passage 107 connecting the discharge chamber 106 to the crank chamber 103, and an electromagnetic control valve 108 arranged in the supply passage 107. When the degree of opening of the control valve 108 is adjusted, the quantity of high pressure gas supplied from the discharge chamber 106 into the crank chamber 103 via the supply passage 107 is controlled with respect to the quantity of gas extracted from the crank chamber 103 into the suction chamber 104 via the extraction passage 105, so that the pressure in the crank chamber 103 can be determined. According to the change in the pressure in the crank chamber 103, a difference between the pressure in the crank chamber 103 and the pressure in the cylinder bores 109 on either side of the piston 102 is changed, so that the inclination angle of the swash plate 101 can be changed. According to the change in the inclination angle of the swash plate 101, the stroke of the pistons 102 is adjusted, that is, the discharge capacity of the compressor can be adjusted.

For example, when the pressure in the crank chamber 103 is raised and a difference between the pressure in the crank chamber 103 and the pressure in the cylinder bores 109 is increased, the inclination angle of the swash plate 101 is decreased, so that the discharge capacity of the compressor is decreased. In the drawing, the swash plate 101 shown by a solid line is located at the minimum inclination angle. On the contrary, when the pressure in the crank chamber 103 is lowered and a difference of between the pressure in the crank chamber 103 and the pressure in the cylinder bores 109 is decreased, the inclination angle of the swash plate 101 is increased, so that the discharge capacity of the compressor is increased. In the drawing, the swash plate 101 shown by a two-dotted chain line is located at the maximum inclination angle.

However, a problem may arise in that, when the air conditioner having the compressor of the above structure, for example, is started at midday or in the afternoon in summer, substantially simultaneously with the start of a vehicle engine, the air conditioning operation should be started immediately according to the demand of an operator, but there is a case in which it takes several tens of seconds to actually start the effective air conditioning operation. The reason why it takes several ten seconds to start the effective air conditioning operation is that the change of the operating condition of the compressor from the minimum discharge capacity state is delayed and it takes time for the compressor to reach the maximum discharge capacity state. The reason why the change of the operating condition from of the compressor the minimum discharge capacity state is delayed is that a large quantity of liquid refrigerant, which stays in the crank chamber 103 during the stoppage of the engine, is agitated and evaporated by the heat generated at the start of the compressor and the rotation of the swash plate 101, and therefore, refrigerant gas cannot be sufficiently extracted from the crank chamber 103 in a short period of time, and the pressure in the crank chamber 103 is kept high. That is, the swash plate 101 is held at the minimum inclination angle irrespective of the adjustment of the degree of opening of the supply passage 107 conducted by the control valve 108 until evaporation of liquid refrigerant in the crank chamber 103 is completed.

The reason why a large quantity of liquid refrigerant stays in the crank chamber 103 during the stoppage of the engine as described above is because of a difference between the thermal capacity of the compressor and that of the condenser 111 or the evaporator 112 in the external refrigerant circuit. That is, the condenser 111 and the evaporator 112, which are heat exchangers, are easily influenced by the change in the temperature in the surroundings, but, the compressor, the thermal capacity of which is large and the surface area of which is small, is less influenced by the change in the temperature in the surroundings. Accordingly, as the temperature of the outside air rises from the morning to the noon, the temperature of the condenser 111 and the evaporator 112, which are easily influenced by the temperature change, is quickly raised and the temperature of the compressor, which is less influenced by the temperature change, is slowly raised, so condensation of refrigerant gas begins in the compressor due to the difference between the temperature of the condenser 111 and the evaporator 112 and the temperature of the compressor. When condensation of refrigerant gas begins in the compressor, the volume of refrigerant is reduced due to the transfer from the gaseous state to the liquid state, and the pressure in the compressor is reduced, so that a flow of refrigerant gas directly from the condenser 111 and the evaporator 112 into the compressor occurs. Refrigerant gas flowing from the condenser 111 and the evaporator 112 into the compressor is condensed and the flow of refrigerant gas into the compressor and the condensation of refrigerant gas in the compressor are repeated. At midday or in the afternoon when the rise of temperature of the outside air is substantially settled and the difference between the temperature of the compressor and the temperature of the condenser 111 and the evaporator 112 becomes smaller, the quantity of liquid refrigerant in the compressor (crank chamber 103) becomes a maximum.

In order to solve the above problems, the following three countermeasures can be considered.

The first countermeasure is that the minimum inclination angle of the swash plate 101 is set to a greater value. By doing so, even if the compressor is in the minimum discharge capacity state, a certain flow rate of refrigerant can be ensured in the refrigerant circulating circuit. Accordingly, even if the change of the operating condition of the compressor from the minimum discharge capacity state is hindered when liquid refrigerant is in the crank chamber 103 as described above, the compressor can suck and discharge a certain amount of refrigerant, so the suction pressure is quickly lowered and refrigerant is quickly extracted from the crank chamber 103, and the operating condition of the compressor can be changed from the minimum discharge capacity state in a short period of time. However, when an absolute value of the minimum discharge capacity is made higher, the compressor can not cope with a state in which the load of air conditioning is low, and in the case where a power transmission mechanism having a clutch between the compressor and the vehicle engine is adopted, it becomes necessary to turn the clutch on and off frequently.

Also, in the case where a clutchless type power transmission mechanism is adopted, the compressor is driven at all times while the engine is being operated. Therefore, when the refrigerating air conditioning is not needed, the discharge capacity of the compressor is minimized so that the load torque can be reduced in order to reduce a power loss of the engine as small as possible. Therefore, if the minimum inclination angle of the swash plate 101 is set to a greater value, it is impossible to reduce the load torque of the compressor when the refrigerating air conditioning is not needed, and the load on the engine is increased.

The second countermeasure is that the diameter of the fixed restriction 105*a* of the extraction passage 105 is increased, that is, the amount of restriction is reduced. When the amount of restriction of the fixed restriction 105*a* is reduced, the refrigerant extracting capacity of the extraction passage 105 is enhanced, and when the compressor is set in motion, liquid refrigerant in the crank chamber 103 can be quickly made to flow into the suction chamber 104. In this case, liquid refrigerant in the crank chamber 103 is made to flow into the suction chamber 104 in the form of gas or liquid. Therefore, pressure in the crank chamber 103 can be quickly reduced and the discharge capacity can be increased.

However, the supply passage 107, the crank chamber 103 and the extraction passage 105, in a sense, constitute a leakage route with respect to the compressed refrigerant gas. Accordingly, the arrangement in which the amount of restriction of the fixed restriction 105*a* of the extraction passage 105 is set small means that a quantity of leakage of compressed refrigerant gas is increased when the discharge capacity is changed, and the efficiency of the compressor is deteriorated. When the amount of restriction of the fixed restriction 105*a* of the extraction passage 105 is set small, a rise in pressure in the crank chamber 103 is slowly conducted. Therefore, the capacity control property is deteriorated, especially when the discharge capacity is changed to a smaller capacity side.

The third countermeasure is that the control valve is composed of a three-way valve, and the degrees of opening of both the extraction passage 105 and the supply passage 107 are adjusted by one control valve. However, in the structure of the three-way valve, a valve element for adjusting the degree of opening of the extraction passage 105 and a valve element for adjusting the degree of opening of the supply passage 107 are integrated in one body, and therefore, it is difficult to conduct such a complicated motion by the three-way valve that the degree of opening of one of the passages 105 and 107 is kept constant and the degree of opening of the other of the passages 105 and 107 is changed.

In order to solve the problems caused in the above three countermeasures, the following two methods can be considered. One is a method in which the fixed restriction 105*a* of the extraction passage 105 is changed into an electromagnetic type variable restriction so that the amount of restriction of the variable restriction can be reduced only when the compressor is set in motion. The other is a method in which a second extraction passage is provided along with the extraction passage 105, and an electromagnetic valve is arranged in the second extraction passage, so that the electromagnetic valve is opened only in the case of starting the compressor. That is, a control valve different from the control valve 108 provided in the supply passage 107 is arranged in the extraction passage. However, this method is disadvantageous in that it is necessary to provide another electromagnetic valve in addition to the control valve 108 and the manufacturing cost is increased and, further, space to install the electromagnetic valves is required.

SUMMARY OF THE INVENTION

The present invention has been accomplished to solve the above problems caused in the prior art. It is an object of the present invention to provide a compact control valve capable of adjusting the degrees of opening of the first and second fluid passages composing a fluid circuit, with a low manufacturing cost. Also, it is an object of the present invention to provide a compact variable capacity type compressor provided with the above control valve.

A control valve, according to the present invention, comprises a valve housing having first and second fluid passages, independently movable first and second plungers arranged in the valve housing, a magnetic flux generating device generating a magnetic flux according to a supplied electric power to provide electromagnetic attraction force acting on and between the first and second plungers, a first valve element connected to the first plunger for adjusting the degree of opening of the first fluid passage, and a second valve element connected to the second plunger for adjusting the degree of opening of the second fluid passage.

In this arrangement, both plungers are movable and respectively connected to the valve elements. Accordingly, the degrees of opening of two fluid passages can be adjusted by one electromagnetic structure (two iron cores and one magnetic flux generating means are combined). Accordingly, the present invention can provide a structure of adjusting the degrees of opening of the fluid passages at low cost and further a space in which the structure is arranged can be reduced, compared with the conventional structure in which it is necessary to provide two electromagnetic structures for adjusting the degrees of opening of two fluid passages. Therefore, the cost and size of the variable capacity compressor can be reduced.

Preferably, a pressure sensitive structure is provided for giving a load to at least one of the first and the second valve elements according to a fluid pressure or a fluid pressure difference in the fluid circuit.

In this arrangement, the fluid pressure or a fluid pressure difference in the fluid circuit is reflected in the adjustment of the degrees of opening of the fluid passage, so it is not necessary to provide an electric structure for detecting the fluid pressure or a fluid pressure difference and also it is not necessary to provide a complicated program for controlling the magnetic flux generating means.

Preferably, a first urging means urging the first plunger away from the second plunger, and a second urging means for separating the second plunger away from the first plunger are further provided, wherein the urging force of the first urging means is different from the urging force of the second urging means, so that the start of movement of the first plunger toward the second plunger against the urging force of the first urging means occurs separately from the start of the movement of the second plunger toward the first plunger against the urging force of the second urging means according to the magnetic attraction force.

In this arrangement, the electromagnetic attraction force to start the movement of the first plunger is made different from the electromagnetic attraction force to start the movement of the second plunger, so it is possible to give the control valve such a characteristics the degree of opening of one of the fluid passages is kept constant and only the degree of opening of the other of the fluid passages is adjusted.

Preferably, the urging force of the first urging means is lower than the urging force of the second urging means, and the control valve includes a first plunger movement restricting means for restricting a movement of the first plunger to approach the second plunger, and according to an increase in the electromagnetic force, the first plunger first moves toward the second plunger to a position restricted by the first plunger movement restricting means against the urging force of the first urging means, and the second plunger then moves toward the first plunger against the urging force of the second urging means.

In this arrangement, when the electromagnetic attraction force is changed in a low range, the degree of opening of the second fluid passage is kept constant, and only the degree of opening of the first fluid passage is adjusted by the first valve element. When the electromagnetic attraction force is changed in a high range, the degree of opening of the first fluid passage is kept constant, and only the degree of opening of the second fluid passage is adjusted by the second valve element.

Preferably, the first and second plungers are coaxially arranged, and the magnetic flux generating means surround the first and second plungers.

The present invention also provides a variable capacity type compressor having a control valve which has an identical feature to the above described one.

In this compressor, preferably, the first fluid passage connects the control chamber to a suction pressure region or a discharge pressure region in the refrigerant circulating circuit, and the second fluid passage connects the control chamber to the suction pressure region or the discharge pressure region, and the discharge capacity can be changed by adjusting the pressure in the control chamber when the degrees of opening of the first and second fluid passages are adjusted by the control valve.

Preferably, one of the first and second fluid passages connects the control chamber to the discharge pressure region, and the other of the first and second fluid passages connects the control chamber to the suction pressure region.

In this arrangement, the most common structure of controlling the discharge capacity is embodied. Both the inlet side control and the outlet side control are conducted by the control valve. The inlet side control is conducted as follows; when the discharge capacity is controlled, the pressure in the control chamber is adjusted by positively adjusting the supply of the high pressure gas from the discharge pressure region. The outlet side control is conducted as follows; when the discharge capacity is controlled, the pressure in the control chamber is adjusted by positively adjusting the extraction of gas into the suction pressure region. Accordingly, compared with a case in which the discharge capacity control is conducted only by one of the inlet side control and the outlet side control, the capacity control property can be enhanced.

Preferably, the control valve includes a pressure sensitive structure for giving a load to at least one of the first and the second valve elements according to refrigerant pressure in the refrigerant circulating circuit or according to a difference of refrigerant pressure.

Preferably, the pressure sensitive structure is composed in such a manner that the degree of opening of the fluid passage is adjusted by at least one of the first and second valve elements so that refrigerant pressure in the refrigerant circulating circuit, which is set by the electromagnetic attraction force, or a difference in the refrigerant pressure, can be maintained.

Preferably, the pressure sensitive structure is composed in such a manner that a load caused by the refrigerant pressure in the suction pressure region is given to at least one of the first and the second valve bodies.

Preferably, the pressure sensitive structure is composed in such a manner that a load caused by a difference between the refrigerant pressure at the first pressure monitoring point and the refrigerant pressure at the second pressure monitoring point, which is set on the downstream side or the lower pressure side of the first pressure monitoring point in the refrigerant circulating circuit, is given to at least one of the first and the second valve bodies.

In this arrangement, as long as the electromagnetic attraction force is not changed, the pressure sensitive structure autonomously adjusts the degree of opening of the fluid passage according to an actually detected fluid pressure or a difference in the fluid pressure so that a constant fluid pressure or a constant difference in the fluid pressure can be maintained. When the electromagnetic attraction force is changed by the control conducted from the outside, setting values of the fluid pressure or the difference in the fluid pressure, which are references of the motion of the pressure sensitive structure, are changed. Therefore, the pressure sensitive structure is operated according to the actual fluid pressure or the difference in the fluid pressure so that these new setting values can be accomplished.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
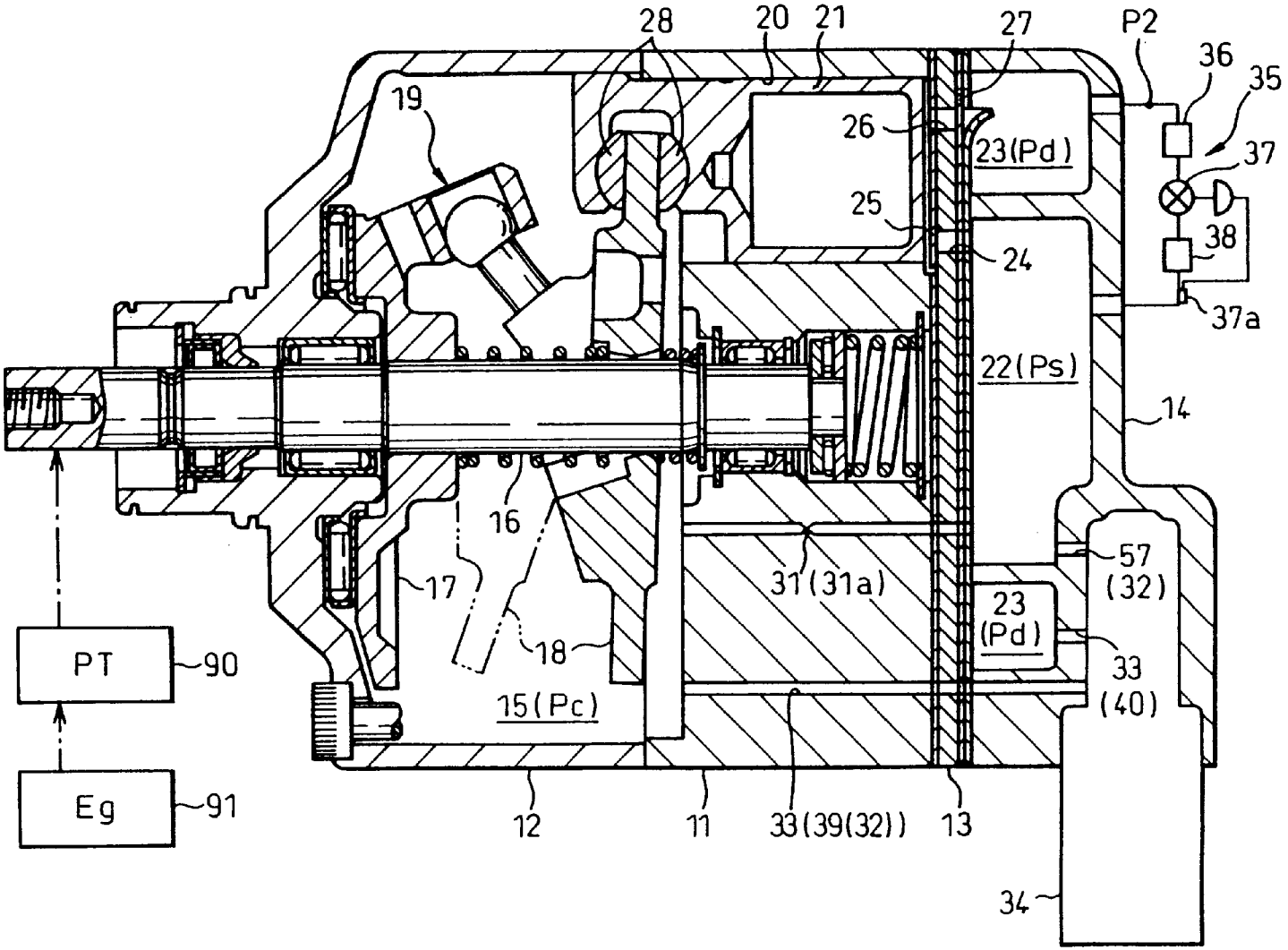
FIG. 1 is a cross-sectional view of a variable capacity type swash plate type compressor according to the embodiment of the present invention.

The present invention will now be explained below with reference to the first, second and third embodiments thereof in which the present invention is embodied as a variable capacity type swash plate type compressor incorporated into a vehicle air conditioner. In this connection, in the second embodiment, only points different from the first embodiment will be explained, and in the third embodiment, only points different from the second embodiment will be explained. Like reference characters are used to indicate like members in these embodiments and repeated explanations will be omitted.

First Embodiment

Variable Capacity Type Swash Plate Type Compressor

As shown in FIG. 1, the variable capacity type swash plate type compressor (hereinafter referred to as a compressor) includes a cylinder block 11, a front housing 12 fixed to the front end of the cylinder block 11, and a rear housing 14 fixed to the rear end of the cylinder block 11 via a valve-port forming body 13. The cylinder block 11, the front housing 12 and the rear housing 14 constitute a housing of the compressor. A crank chamber 15 is defined in a region enclosed by the cylinder block 11 and the front housing 12. A drive shaft 16 is rotatably supported by the cylinder block 11 and the front housing 12, passing through the crank chamber 15. A lug plate 17 is fixed to the drive shaft 16 in the crank chamber 15 for rotation therewith.

The front end portion of the drive shaft 16 is connected to a vehicle engine (Eg) 91, which is an external drive source, via a power transmission mechanism (PT) 90. Power transmission mechanism (PT) 90 can be of the type including a clutch mechanism (for example, an electromagnetic clutch) capable of selectively transmitting and disconnecting power by an electric control conducted from the outside. Alternatively, the power transmission mechanism (PT) 90 can be of a type having a clutchless mechanism (for example, a combination of a belt and a pulley) by which power can be transmitted at all times. In this embodiment, the clutchless type power transmission mechanism (PT) 90 is adopted.

A swash plate 18, which is a cam plate, is accommodated in the crank chamber 15. The swash plate 18 is slidably and tiltably supported by the drive shaft 16. A hinge mechanism 19 is interposed between the lug plate 17 and the swash plate 18. Accordingly, the swash plate 18 is pivotally connected to the lug plate 17 via the hinge mechanism 19 and slidably supported by the drive shaft 16, so that the swash plate 18 can rotate synchronously with the lug plate 17 and the drive shaft 16, and can tilt or incline with respect to the drive shaft 16 while the swash plate 18 is being slid in the axial direction of the drive shaft 16.

A plurality of cylinder bores (only one is shown in the drawings) 20 are formed in and through the cylinder block 11 around the drive shaft 16. A single headed piston 21 is reciprocatingly housed in each cylinder bore 20. The front opening and rear opening of the cylinder bore 20 are closed by the valve-port forming body 13 and the piston 21, so a compression chamber, the volume of which changes according to the reciprocating motion of the piston 21, is defined in this cylinder bore 20. The piston 21 is connected to the outer circumferential section of the swash plate 18 via shoes 28. Accordingly, the rotational motion of the swash plate 18 caused by the rotation of the drive shaft 16 is converted into the reciprocating motion of the pistons 21 via the shoes 28.

A suction chamber 22 forming a suction pressure (Ps) region and a discharge chamber 23 forming a discharge pressure (Pd) region are respectively defined in the region surrounded by the valve-port forming body 13 and the rear housing 14. Refrigerant gas in the suction chamber 22 is sucked into the cylinder bore (compression chamber) 20 via a suction port 24 and a suction valve 25 of the valve-port forming body 13 when the piston 21 is moved from the top dead center to the bottom dead center. Refrigerant gas sucked into the cylinder bore 20 is compressed to a certain pressure and discharged into the discharge chamber 23 via a discharge port 26 and a discharge valve 27 of the valve-port forming body 13 when the piston 21 is moved from the bottom dead center to the top dead center.

The inclination angle of the swash plate 18 (the angle between the swash plate 18 and a virtual plane perpendicular to the drive shaft 16) is adjustable by changing the relationship between the pressure in the cylinder bore (compression chamber) 20 and the pressure Pc in the crank chamber 15, which is a back pressure to the piston 21. In this embodiment, the inclination angle of the swash plate 18 is adjusted by positively changing the pressure Pc in the crank chamber 15.

Control of Pressure in Crank Chamber

Figure 2:
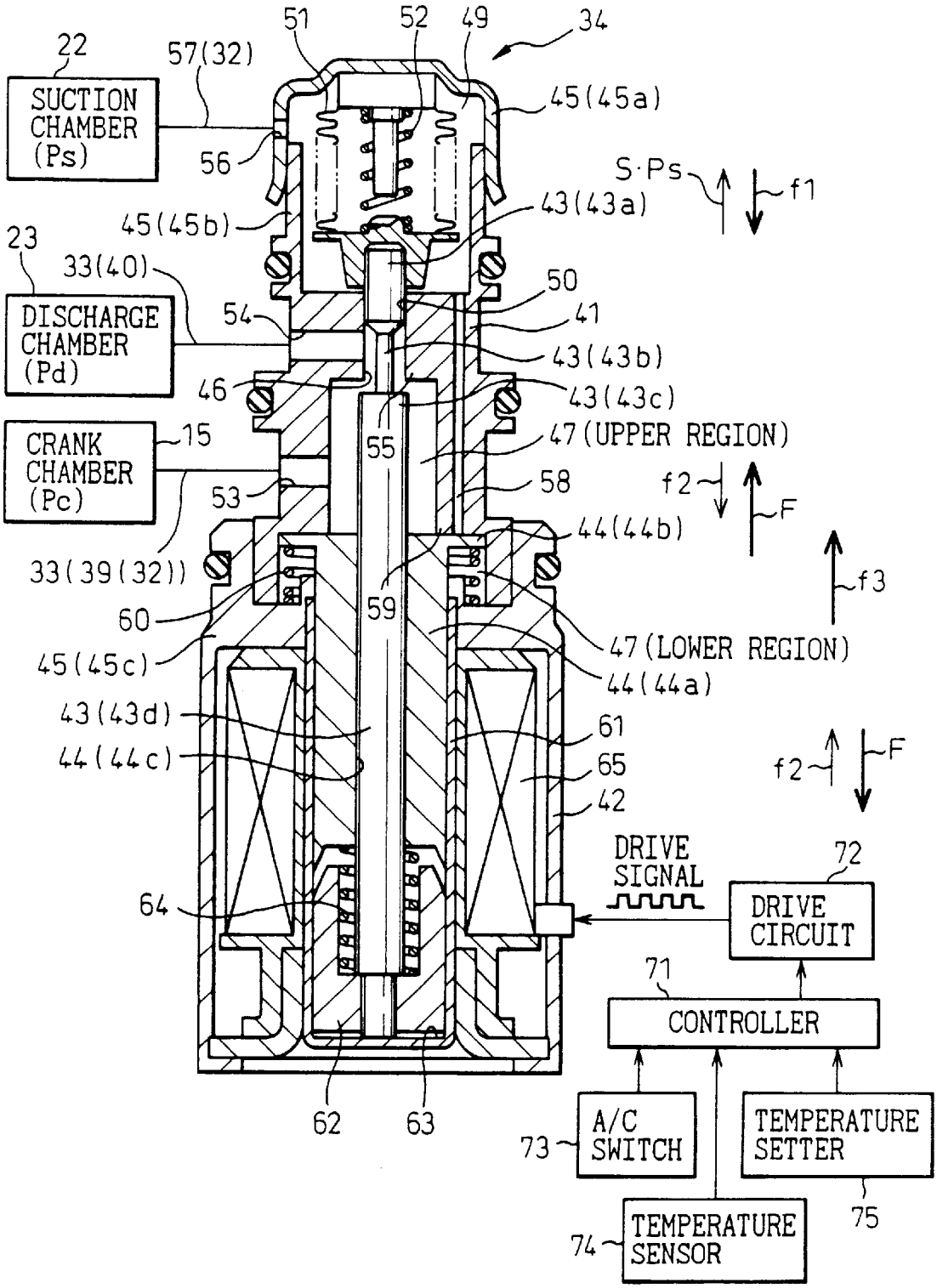
FIG. 2 is a cross-sectional view of the control valve of FIG. 1.

As shown in FIGS. 1 and 2, the arrangement for controlling the pressure Pc in the crank chamber 15 of the compressor comprises a first extraction passage 31, a second extraction passage 32 as a second fluid passage, a supply passage 33 as a first fluid passage, a control valve 34, and a pressure detecting passage 57, all provided in the housing 11 and 14 of the compressor. The first extraction passage 31 and the second extraction passage 32 connects the crank chamber 15 with the suction chamber 22. The supply passage 33 connects the discharge chamber 23 with the crank chamber 15. The first extraction passage 31 has a fixed restriction 31*a* at the intermediate portion thereof, and the suction chamber 22 normally communicates with the crank chamber 15 though the first extraction passage 31. The control valve 34 is arranged in the second extraction passage 32 and the supply passage 33. The pressure detecting passage 57 is arranged between the control valve 34 and the suction chamber 22. A hole 39 is provided in and through the cylinder block 11, the valve-port forming body 13 and the rear housing 14. The hole 39 acts as a part of the second extraction passage 32 as well as a part of the supply passage 33.

In this arrangement, the pressure Pc in the crank chamber 15 is determined by adjusting the degree of opening of the control valve 34, to control the amount of the high pressure discharge gas introduced from the discharge chamber 23 into the crank chamber 15, via the supply gas passage 33, relative to the amount of the gas extracted from the crank chamber 15 into the suction chamber 22 via the first and second extraction passage 31 and 32. According to a change in the pressure Pc in the crank chamber 15, the difference between the pressure Pc in the crank chamber 15 and the pressure in the cylinder bore 20 on either side of the piston 21 is changed and the inclination angle of the swash plate 18 is changed between the minimum inclination angle (shown by a solid line in FIG. 1) at which the inclination angle is substantially 0° and the maximum inclination angle (shown by a two-dotted chain line in FIG. 1). According to the change in the inclination angle of the swash plate 18, the stroke of the piston, that is, the discharge capacity of the compressor is adjusted.

Refrigerant Circulating Circuit

As shown in FIG. 1, the air conditioning circuit (refrigerant circulating circuit) of the vehicle air conditioner, as a fluid circuit, comprises the compressor and an external refrigerant circuit 35. The external refrigerant circuit 35 includes a condenser 36, a thermal type expansion valve 37 to be used as a decompression device, and an evaporator 38. The degree of opening of the expansion valve 37 is feedback controlled according to the detected temperature of a temperature sensitive cylinder 37*a* arranged on the exit side or on the downstream side of the evaporator 38 and the evaporating pressure (pressure at the exit of the evaporator 38). The expansion valve 37 supplies liquid refrigerant to the evaporator 38 to match the flow rate corresponding to the thermal load, to control the flow rate of refrigerant in the external refrigerant circuit 35. In this connection, the compressor (in particular, the discharge chamber 23 with which the piping on the condenser 36 side in the external refrigerant circuit 35 is connected, the suction chamber 22 with which the piping on the evaporator 38 side is connected, and the cylinder bore 20 which connects the suction chamber 22 with the discharge chamber 23 via the ports 24 and 26) and the external refrigerant circuit 35 are deemed as a primary circuit of the refrigerant circulating circuit, and the refrigerant passages 31 to 33 and 57 for controlling the pressure Pc in the crank chamber 15 of the compressor are deemed as an auxiliary circuit of the refrigerant circulating circuit.

Control Valve

As shown in FIG. 2, the control valve 34 includes a valve function section 41 occupying an upper half part thereof, and an electric drive section 42 occupying a lower half part thereof. The valve function section 41 adjusts the degree of opening of the supply gas passage 33 connecting the discharge chamber 23 to the crank chamber 15, and the degree of opening of the second extraction gas passage 32 connecting the crank chamber 15 to the suction chamber 22. The control valve 34 includes a first plunger 62, an operation rod 43 coupled to the first plunger 62, and a second plunger 44. The electric drive section 42 is a kind of electromagnetic actuator for controlling the position of the operation rod 43 (first plunger 62) and the second plunger 44, according to an external electric control. The operation rod 43 includes a pressure sensitive rod section 43*a*, a connecting section 43*b*, a first valve section 43*c* as a first valve element and a solenoid section 43*d*, arranged in this order from the upper end to the lower end of the operation rod 43. The first valve section 43*c* is a portion of the solenoid rod section 43*d*. The second plunger 44, comprises a sleeve section 44*a* as a body thereof and a second valve section 44*b* as a second valve body formed in the flange-shape at the upper end of the sleeve section.

The control valve 34 has a valve housing 45 including a cap 45*a*, an upper half body 45*b* constituting a main shell of the valve function section 41, and a lower half body 45*c* constituting a main shell of the electric drive section 42. A first communicating passage 46 and a valve chamber 47 are defined in the upper half body 45*b* of the valve housing 45. A pressure sensitive chamber 49 is defined between the upper half body 45*b* and the cap 45*a* put on the upper portion of the upper half body 45*b*. A pressure sensitive rod guide hole 50 penetrates the valve housing 45 between the pressure sensitive chamber 49 and the first communicating passage 46. A pressure sensitive rod guide hole 50 is formed continuously with the first communicating passage 46. A bellows 51 as a pressure sensitive member is housed in the pressure sensitive chamber 49. A setting spring 52 is arranged in the bellows 51. The setting spring 52 sets the initial length of the bellows 51.

A first port 53 is formed in and radially through the circumferential wall of the valve housing 45 surrounding the upper region of the valve chamber 47. The first port 53 connects the valve chamber 47 to the crank chamber 15 via the first passage (hole) 39 which is a downstream part of the supply passage 33. A second port 54 is formed in and radially through the circumferential wall of the valve housing 45 surrounding the first communicating passage 46. The second port 54 is perpendicular to the first communicating passage 46 and connect the first communicating passage 46 to the discharge chamber 23 via a second passage 40 which is an upstream part of the supply gas passage 33. Accordingly, the first port 53, the valve chamber 47 (upper region), the first communicating passage 46 and the second port 54 constitute a portion of the supply passage 33 in the control valve 34.

The operation rod 43 is arranged in the valve chamber 47, the first communicating passage 46 and the pressure sensitive chamber 49 so that the operation rod 43 can move in the axial direction (vertical direction in the drawing) of the housing 45. The pressure sensitive rod section 43*a* of the operation rod 43 is slidably inserted in the pressure sensitive rod guide hole 50, and the upper end of the pressure sensitive rod section 43*a* is slidably fitted in the lower end of the bellows 51. Accordingly, the operation rod 43 (the first valve section 43*c*) is operatively coupled to the bellows 51, by the upper end of the pressure sensitive rod section 43*a* in abutment with the bellows 51. The connecting section 43*b* of the operation rod 43 is inserted into the first communicating passage 46. The diameter of the connecting section 43*b* is smaller than that of the first communicating passage 46 so that the connecting section 43*b* does not shut off the flow of gas in the first communicating passage 46.

Figure 3:
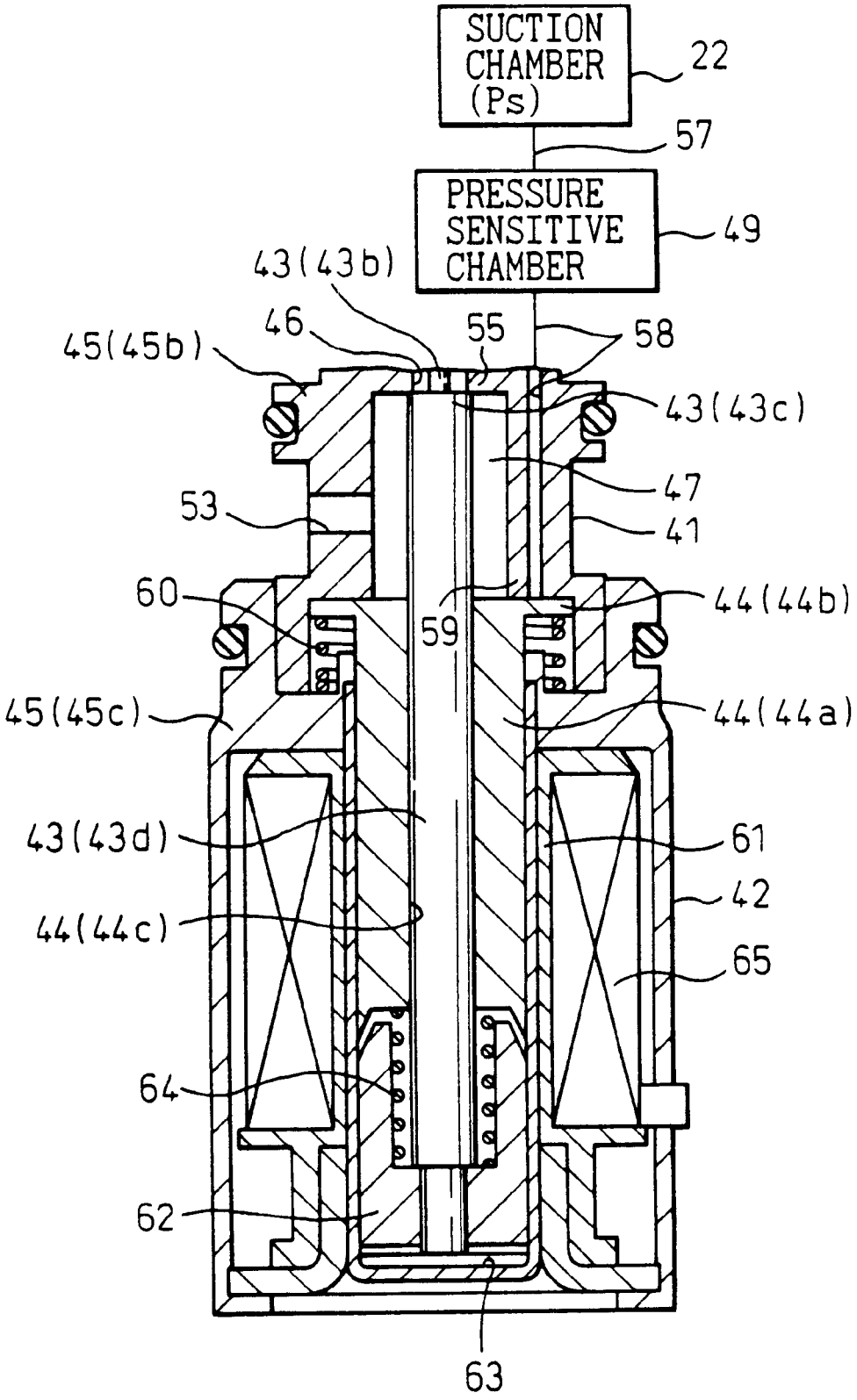
FIG. 3 is a cross-sectional view of the control valve for explaining the operation of the control valve, with the first plunger seated on its valve seat.

The first valve section 43*c* of the operation rod 43 is arranged in the uppermost region in the valve chamber 47. The uppermost region of the valve chamber 47 has a step portion, located at the boundary with the first communicating passage 46, which step portion functions as a first valve seat 55, and the first communicating passage 46 functions as a kind of valve hole. Accordingly, when the operation rod 43 is moved upward from the position (the lowermost position) shown in FIG. 2 to the position (the uppermost position) shown in FIG. 3 at which the first valve section 43*c* is seated on the first valve seat 55, the first communicating passage 46 is shut off. That is, the first valve section 43*c* of the operation rod 43 functions as an inlet side valve element by which the degree of opening of the supply passage 33 can be arbitrarily adjusted.

A third port 56 is arranged in the circumferential wall of the cap 45*a* surrounding the pressure sensitive chamber 49. The pressure sensitive chamber 49 is normally connected to the suction chamber 22 via the third port 56 and the detecting pressure passage 57. Accordingly, the pressure Ps in the suction chamber 22, as the refrigerant pressure, is introduced into the pressure sensitive chamber 49 via the detecting pressure passage 57 and the third port 56. In this embodiment, the third port 56, the pressure sensitive chamber 49 and the bellows 51 constitute the pressure sensitive structure.

A second communicating passage 58 is formed in the valve housing 45 at an offset position and connects the lower region of the valve chamber 47 to the pressure sensitive chamber 49. The second valve element 44*b* of the second plunger 44 is arranged in the valve chamber 47 as a movable wall which divides the valve chamber 47 into an upper region and a lower region. The valve chamber 47 has a step portion at the boundary with the second communicating passage 58, which step portion functions as the second valve seat 59, and the second communicating passage 58 functions as a kind of valve hole. Accordingly, when the second plunger 44 is moved downward from the position (the uppermost position) shown in FIG. 3, at which the second valve section 44*b* of the second plunger 44 is seated on the second valve seat 59 and shuts off the second communicating passage 58, to the position (the lowermost position) shown in FIG. 4, the second communicating passage 58 can be opened. A second urging spring 60 is interposed between the bottom surface of the valve chamber 47 and the second valve section 44*b* of the second plunger 44 and urges the second plunger 44 in a direction so that the second valve section 44*b* is seated on the second valve seat 59.

The detecting pressure passage 57, the third port 56, the pressure sensitive chamber 49, the second communicating passage 58, the valve chamber 47, the first port 53 and the first passage 39 constitute the second extraction passage 32 and the second valve element 44*b* of the second plunger 44 functions as an exit side valve by which the degree of opening of the second extraction passage 32 can be arbitrarily adjusted.

The electric drive section 42 is provided with an accommodation cylinder 61 having a bottom. The sleeve section 44*a* of the second plunger 44 is inserted in the accommodation cylinder 61 from its upper opening side so that it is movable in the axial direction of the valve housing 45. The first plunger 62 is accommodated in a plunger chamber 63, which is defined in the lower region of the accommodation cylinder 61 below the inserted second plunger 44 (sleeve 44*a*) so that it is movable in the axial direction of the valve housing 45. A solenoid rod guide hole 44*c* is formed in the center of the second plunger 44, and the solenoid rod section 43*d* of the operation rod 43 is arranged in this solenoid rod guide hole 44*c* so that it is movable in the axial direction of the valve housing 45.

The lower end portion of the solenoid rod section 43*d* of the operation rod 43 extends into the plunger chamber 63, and the first plunger 62 is engaged with and fixed to this extending section. Accordingly, the first plunger 62 and the operation rod 43 move together upward and downward. A first urging spring 64 is arranged in the plunger chamber 63 between the first plunger 62 and the second plunger 44. Urging force f2 of the first urging spring 64 acts on the first plunger 62 downward so that the first plunger 62 is urged away from the second plunger 44 and also acts on the second plunger 44 upward so that the second plunger 44 is urged away from the first plunger 62.

A coil 65, as a magnetic flux generating means, is wound around both the plungers 44 and 62 and extends over a range covering both the plungers. A drive signal is supplied from the drive circuit 72 to the coil 65 according to a command given by the control device 71, and the electromagnetic attraction force F acting between the first plunger 62 and the second plunger 44 can be adjusted, by adjusting the density of magnetic flux of the coil 65 according to electric power supplied to the coil 65.

The electrical control of the coil 65 is carried out by adjusting the voltage applied to the coil 65. The adjustment of the applied voltage is generally carried out by means in which the voltage itself is changed or by means of a PWM method in which a pulse voltage of a constant period is applied and the time width of the pulse is changed so that the average voltage is adjusted. The applied voltage is obtained by the calculation of (voltage value of pulse)×(pulse width)/(pulse period). In this case, (pulse width)/(pulse period) is referred to as a duty ratio, and the voltage control to which PWM is applied is sometimes referred to as a duty control. When the PWM means is adopted, the electric current changes like a pulsation, which becomes a dither. Therefore, it can be expected that hysteresis of the electromagnet is reduced. Also, it is a common method that an intensity of an electric current flowing in the coil 65 is measured and subjected to a feedback control so that the applied voltage can be adjusted. In this embodiment, duty ratio control is adopted.

Consideration on Operating Condition and Characteristics of Control Valve

In the control valve 34 shown in FIG. 2, the degree of opening of the first communicating passage 46 (supply passage 33) is determined by the position of the operation rod 43 including the first valve section 43*c* as the first valve element. In the control valve 34, the degree of opening of the second communicating passage 58 (second extraction passage 32) is determined by the position of the second plunger 44 including the second valve section 44*b* as the second valve element.

First, the position of the operation rod 43 will be explained below. As shown in FIG. 2, the urging force f1 of the setting spring 52, which is directed downward in the drawing, and the urging force (effective pressure receiving area S of bellows 51×suction pressure Ps) of the bellows 51 according to suction pressure Ps, which is directed upward in the drawing, act on the pressure sensitive rod section 43*a* of the operation rod 43, that is, the force (f1−S·Ps) acts on the pressure sensitive rod section 43*a* of the operation rod 43. On the other hand, the electromagnetic attraction force F, which is directed upward (in the direction of the second plunger 44), and the urging force f2 of the first urging spring 64, which is directed downward, act on the solenoid rod section 43*d* of the operation rod 43, that is, the force (F−f2) acts on the solenoid rod section 43*d* of the operation rod 43. That is, the setting spring 52 and the first urging spring 64 constitute a first urging means which urges the first plunger 62 away from the second plunger 44. Due to the foregoing, the dynamic relationship of the operation rod 43 can be expressed by the following formula 1.

$$f1-S\cdot Ps=F-f2 \tag{1}$$

This formula 1 can be transformed into the following formula 2.

$$Ps=(f1+f2-F)/S \tag{2}$$

Figure 5:
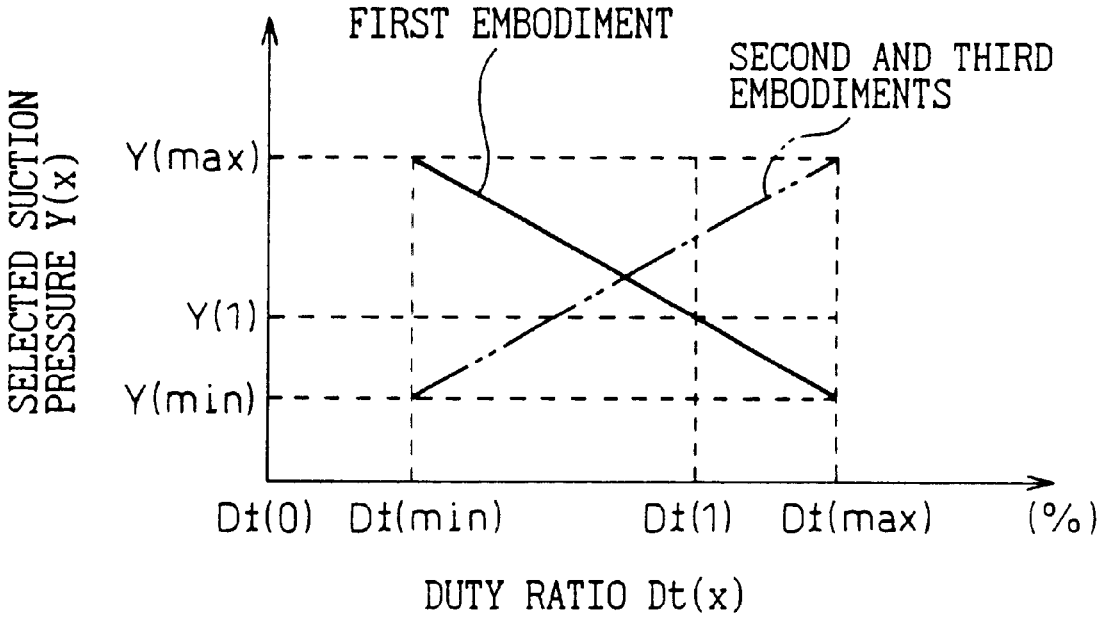
FIG. 5 is a graph showing the relationship between the duty ratio and the selected suction pressure.

In this case, the urging force f1 of the setting spring 52, the urging force f2 of the first urging spring 64 and the effective pressure receiving area S of the bellows 51 are definite parameters which are decisively determined in the designing stage. Suction pressure Ps is a variable parameter which changes according to the operating condition of the compressor, and the electromagnetic attraction force F is a variable parameter which changes according to the electric power supplied to the coil 65. From the formula 2, it can be said that the control valve 34 shown in FIG. 2 is of the structure that the setting value (setting suction pressure Y(x)) of the suction pressure Ps, which is a reference of the motion of the operation rod 43, can be decisively determined from outside by the duty control conducted on the coil 65. In more detail, as shown in FIG. 5, when duty ratio Dt(x) of the coil 65 for giving a command to the drive circuit 72 is made higher so as to increase the electromagnetic attraction force F, the setting suction pressure Y(x) is decreased. on the contrary, when the duty ratio Dt(x) is made lower so as to decrease the electromagnetic attraction force F, the setting suction pressure Y(x) is increased.

Next, the position of the second plunger 44 will be explained below. As shown in FIG. 2, the urging force f3 of the second urging spring 60, which is directed upward in the drawing, acts on the second valve section 44*b* of the second plunger 44. Electromagnetic attraction force F, which is directed downward, and the urging force f2 of the first urging spring 64, which is directed upward, act on the sleeve section 44*a* of the second plunger 44. That is, the first urging spring 64 and the second urging spring 60 constitute the second urging means which move the second plunger 44 away from the first plunger 62. Due to the foregoing, the dynamic relationship of the second plunger 44 can be expressed by the following formula 3.

$$f2+f3=F \quad (3)$$

In this case, the urging force f2 of the first urging spring 64 and the urging force f3 of the second urging spring 60 are definite parameters which are decisively determined at the stage of designing. Electromagnetic force F is a variable parameter which changes according to the electric power supplied to the coil 65. From the above formula 3, it can be said that the control valve 34 shown in FIG. 2 is operated such that when the electromagnetic attraction force F is higher than the spring urging force (f2+f3), the second plunger 44 leaves the uppermost position and the second valve section 44*b* opens the second communicating passage 58, and when the electromagnetic attraction force F is lower than the spring urging force (f2+f3), the second plunger 44 is arranged at the uppermost position and the second valve section 44*b* closes the second passage 58.

In this embodiment, the urging force f3 of the second urging spring 60 is set to be much stronger than the urging force f2 of the first urging spring 64. The urging force (f2+f3) of the second urging spring 60 and the first urging spring 64 is set to be lower than the electromagnetic attraction force F in the state of (Dt(x) is in the range from Dt(1) to Dt(max)) in which the duty ratio Dt(x) sets the setting suction pressure Y(x) at a value lower than Y(1).

In this connection, the arrangement of the operation rod 43 and the second plunger 44 is explained in the condition that the bellows 51 is given only the suction pressure Ps in the pressure sensitive chamber 49 and influences given by other factors are excluded.

According to the control valve 34 having the above operational characteristics, the degree of opening of the first valve section 43*c* and the degree of opening of the second valve section 44*b* are determined under the respective circumstances, as follows.

First, when no voltage is supplied to the coil 65 or a very low voltage is supplied to the coil 65 (the duty ratio Dt(x) is in the range from Dt(0) to Dt(min)), the first urging spring 64 mainly determines the location of the operation rod 43, and the operation rod 43 is located at the lowermost position so that the first valve section 43*c* holds the first communicating passage 46 (supply passage 33) in the fully open state, since the operation rod 43 and the bellows 51 are releasably engaged with each other even if the actual suction pressure Ps is high. At this time, the electromagnetic attraction force F is much lower than the urging force (f2+f3) of the first urging spring 64 and the second urging spring 60, so the second plunger 44 is located at the uppermost position, and the second valve section 44*b* holds the second communicating passage 58 (the second extraction gas passage 32) in the fully closed state.

When a certain voltage is supplied to the coil 65 (the duty ratio Dt(x) is in the range from Dt(min) to Dt(1)), regarding the operation rod 43, the upward electromagnetic attraction force F is higher than at least the downward urging force f2 of the first urging spring 64. Accordingly, the setting suction pressure Y(x) can be set in the range from Y(1) to Y(max). Therefore, the operation rod 43 is located at a position satisfying the formula 2 according to the fluctuation of suction pressure Ps, and the degree of opening of the supply passage 33 can be adjusted. However, in this case, it is true that the electromagnetic attraction force F is higher than that of the above case (the duty ratio Dt(x) is in the range from Dt(0) to Dt(min)), but the electromagnetic attraction force F is still lower than the urging force (f2+f3) of the first urging spring 64 and the second urging spring 60. Due to the foregoing, the second plunger 44 is located at the uppermost position, and the second valve section 44*b* holds the second extraction passage 32 in the fully closed state.

When a further certain voltage is applied to the coil 65 (the duty ratio Dt(x) is in the range from Dt(min) to Dt(1)), the electromagnetic attraction force F mainly determines the location of the operation rod 43, and the setting suction pressure Y(x) is set in the lower range (Y(min) to Y(1)). It is actually not likely to occur that the actual suction pressure Ps becomes lower than the setting suction pressure Y(min) to Y(1), and the operation rod 43 is located at the uppermost position, and the first valve section 43*c* holds the supply gas passage 33 in the fully closed state. The electromagnetic attraction force F at this time becomes higher than the urging force (f2+f3) of the first urging spring 64 and the second urging spring 60. Therefore, the second plunger 44 leaves the uppermost position, and the second valve section 44*b* opens the second extraction passage 32.

Due to the foregoing, the control valve 34 is operated as follows. According to the increase in the electromagnetic force F, the operation rod 43 (the first plunger 62) is moved upward from the lowermost position, and the first valve section 43*c* is seated on the first valve seat 55, whereby the further upward movement of the operation rod 43 is restricted. In other words, the first plunger 62 is restricted from further approaching the second plunger 44; and after that, the second plunger 44 starts leaving the uppermost position. Accordingly, the first valve seat 55 constitutes the first plunger movement restricting means which restricts the first plunger 62 (the operation rod 43) from moving upward anymore.

Control System

As shown in FIG. 2, a control unit 71 is similar to a computer which includes a CPU, a ROM, a RAM and an I/O interface. An air conditioner switch 73, which is an ON/OFF switch of an air conditioner operated by a driver, a passenger compartment temperature sensor 74 for detecting passenger compartment temperature Te(t) and a passenger compartment temperature setting device 75 for setting a preferable temperature Te (set) in the passenger compartment are respectively connected to the input terminals of I/O of the control unit 71. The drive circuit 72 for controlling the supply of electric power to the control valve 34 (coil 65) is connected to the output terminal of I/O of the control unit 71.

The control unit 71 determines the duty ratio Dt(x) to be given to the drive circuit 72, based on the state of ON/OF of the air conditioner switch 73, the information of the detected temperature Te(t) sent from the passenger compartment temperature sensor 74, and the information of the setting temperature Te (set) of the passenger compartment temperature setting device 75.

Air Conditioning Control

Figure 6:
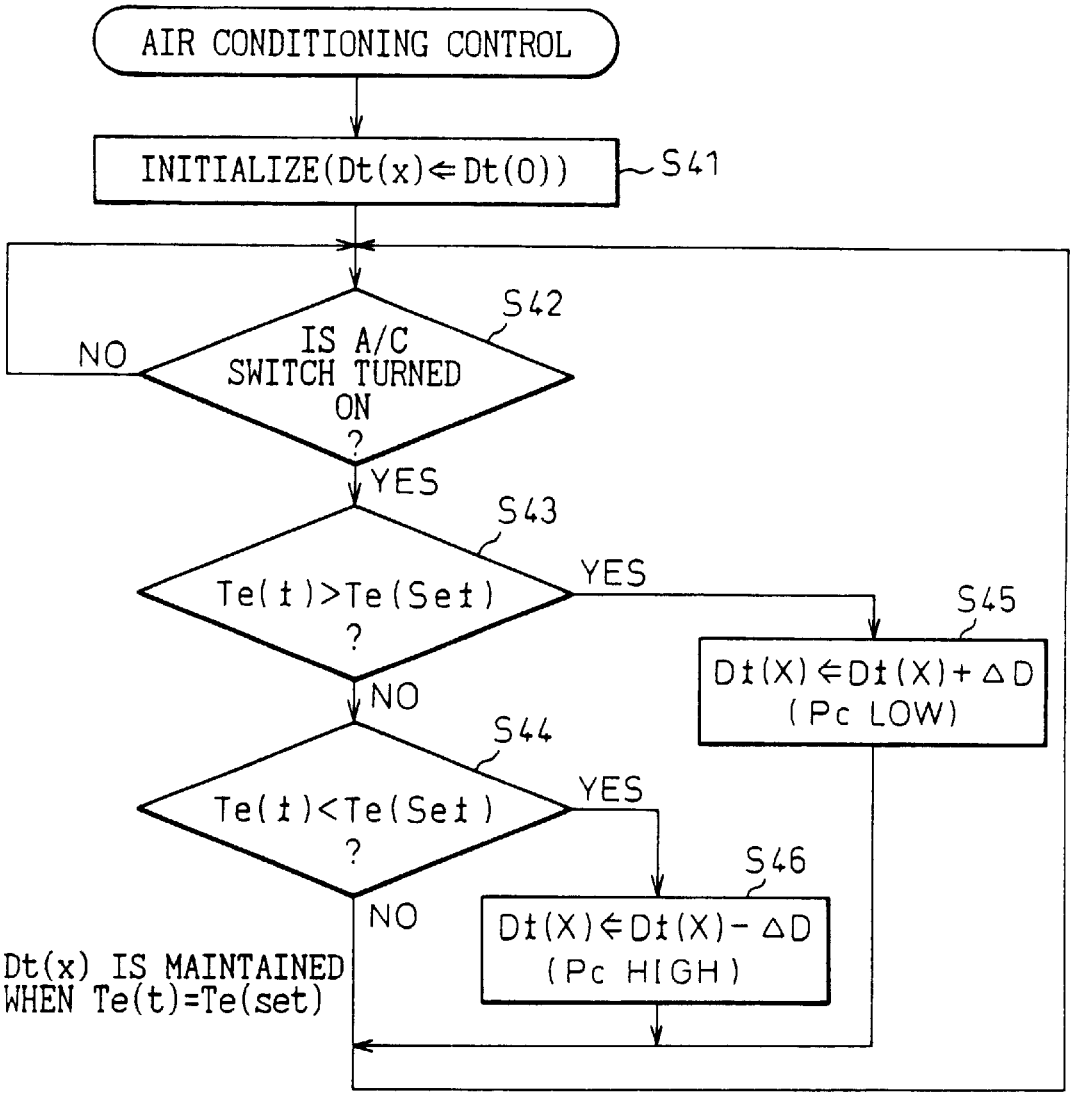
FIG. 6 is a flow chart for explaining the function of the controller.

When the ignition switch (or a start switch) of a vehicle (not shown) is turned on, the control unit 71 is supplied with electric power and starts controlling according to the flow chart shown in FIG. 6. That is, in step S41 (hereinafter referred simply to as "S41", and other steps are also referred to similarly), the control unit 71 conducts various initial settings according to the predetermined initial program. For example, the control unit 71 gives an initial value (Dt(x)= Dt(0)) to the duty ratio Dt(x) of the control valve 34 (coil 65). After that, the program proceeds to S42 in which monitoring and calculation of the duty ratio Dt(x) are conducted.

In S42, the ON/OFF state of the air conditioner switch 73 is monitored. When the air conditioner switch 73 is turned on, in S43, the control unit 71 judges whether or not the detected temperature Te(t) of the passenger compartment temperature sensor 74 is higher than the setting temperature Te(set) of the passenger compartment temperature setting device 75. If the result is NO in the judgment conducted in S43, the program proceeds to S44, and it is judged whether or not the detected temperature Te(t) is lower than the setting temperature Te(set). If the result is NO in the judgment conducted in S44, the detected temperature Te(t) coincides with the setting temperature Te(set), so it is not necessary to change the suction pressure Ps, that is, it is not necessary to change the duty ratio Dt(x) which leads to a change in the air-conditioning capacity. Therefore, the control unit 71 does not give a command to change the duty ratio Dt(x) to the drive circuit 72, and the program jumps to S42.

If the result is YES in S43, it is estimated that the passenger compartment is hot and the thermal load is heavy, so the program proceeds to S45, and the control unit 71 increases the duty ratio Dt(x) by the unit value ΔD, and gives a command to the drive circuit 72 so that the duty ratio Dt(x) can be changed to the corrected value of (Dt(x)+ΔD), whereby the setting suction pressure Y(x) can be reduced a little. The electromagnetic attraction force F of the electric drive section 42 is thus increased a little, and the upward and the downward urging forces cannot be well balanced under the suction pressure Ps at this time, so the operation rod 43 is moved upward, and forces are accumulated in the setting spring 52 and the first urging spring 64. An increase in the downward urging force (f1+f2) of the setting spring 52 and the first urging spring 64 compensates for an increase in the upward electromagnetic attraction force F, and the first valve section 43*c* of the operation rod 43 can be positioned. As a result, the degree of opening of the first communicating passage 46 (the supply passage 33) is reduced a little, and the pressure Pc in the crank chamber 15 tends to decrease. Therefore, the difference between the pressure Pc in the crank chamber 15 and the pressure in the cylinder bore 20 on either side of the piston 21 is reduced, so that the swash plate 18 is inclined in the direction in which the inclination angle is increased, and the discharge capacity of the compressor is increased. When the discharge capacity of the compressor is increased, the flow rate of the refrigerant in the refrigerant circulating circuit is increased, and the heat absorbing capacity of the evaporator 38 is enhanced, whereby the temperature Te(t) tends to decrease and the suction pressure Ps is reduced.

On the other hand, if the result is YES in S44, it is estimated that the passenger compartment is cold and the thermal load is light, so the program proceeds to S46, and the control unit 71 decreases the duty ratio Dt(x) by the unit value ΔD, and gives a command to the drive circuit 72 so that the duty ratio Dt(x) can be changed to the corrected value of (Dt(x)−ΔD), whereby the setting suction pressure Y(x) can be increased a little. The electromagnetic attraction force F of the electric drive section 42 is thus decreased a little, and the upward and the downward urging forces cannot be well balanced under the suction pressure Ps at this time. Accordingly, the operation rod 43 is moved downward, and forces accumulated in the setting spring 52 and the first urging spring 64 are decreased. A decrease in the downward urging force (f1+f2) of the setting spring 52 and the first urging spring 64 compensates for a decrease in the upward electromagnetic attraction force F, and the first valve section 43*c* of the operation rod 43 can be positioned. As a result, the degree of opening of the control valve 34 is increased a little, that is, the degree of opening of the supply passage 33 is increased a little, and the pressure Pc in the crank chamber 15 tends to increase. Therefore, the difference between pressure Pc in the crank chamber 15 and the pressure in the cylinder bore 20 on either side of the piston 21 is increased, so that the swash plate 18 is inclined in the direction in which the inclination angle is decreased, and the discharge capacity of the compressor is decreased. When the discharge capacity of the compressor is decreased, the flow rate of the refrigerant in the refrigerant circulating circuit is decreased, and the heat absorbing capacity of the evaporator 38 is reduced, whereby the temperature Te(t) tends to increase and the suction pressure Ps is increased.

In this way, the temperature Te(t) converges to a value close to the setting temperature Te(set) during the correcting procedure of the duty ratio Dt(x) in S45 and/or S46, since the duty ratio Dt(x) is gradually optimized and the degree of opening of the control valve 34 is autonomously adjusted even if the detected temperature Te(t) deviates from the setting temperature Te(set).

As described in the description of the prior art, for example, when the vehicle air conditioner is started at midday or in the afternoon in summer under the condition that the setting temperature Te(set) is set at a low value (in particular, when the air conditioner switch 73 is in the ON position in and the detected temperature Te(t) is much higher than the setting temperature Te(set) at the start of the engine EG since the power transmission mechanism PT is clutchless in this embodiment), and under the circumstance where a large quantity of liquid refrigerant stays in the crank chamber 15 of the compressor, the compressor does not immediately change its operating condition from the minimum discharge capacity state and the detected temperature Te(t) continues to greatly exceed the setting temperature Te(set).

Figure 4:
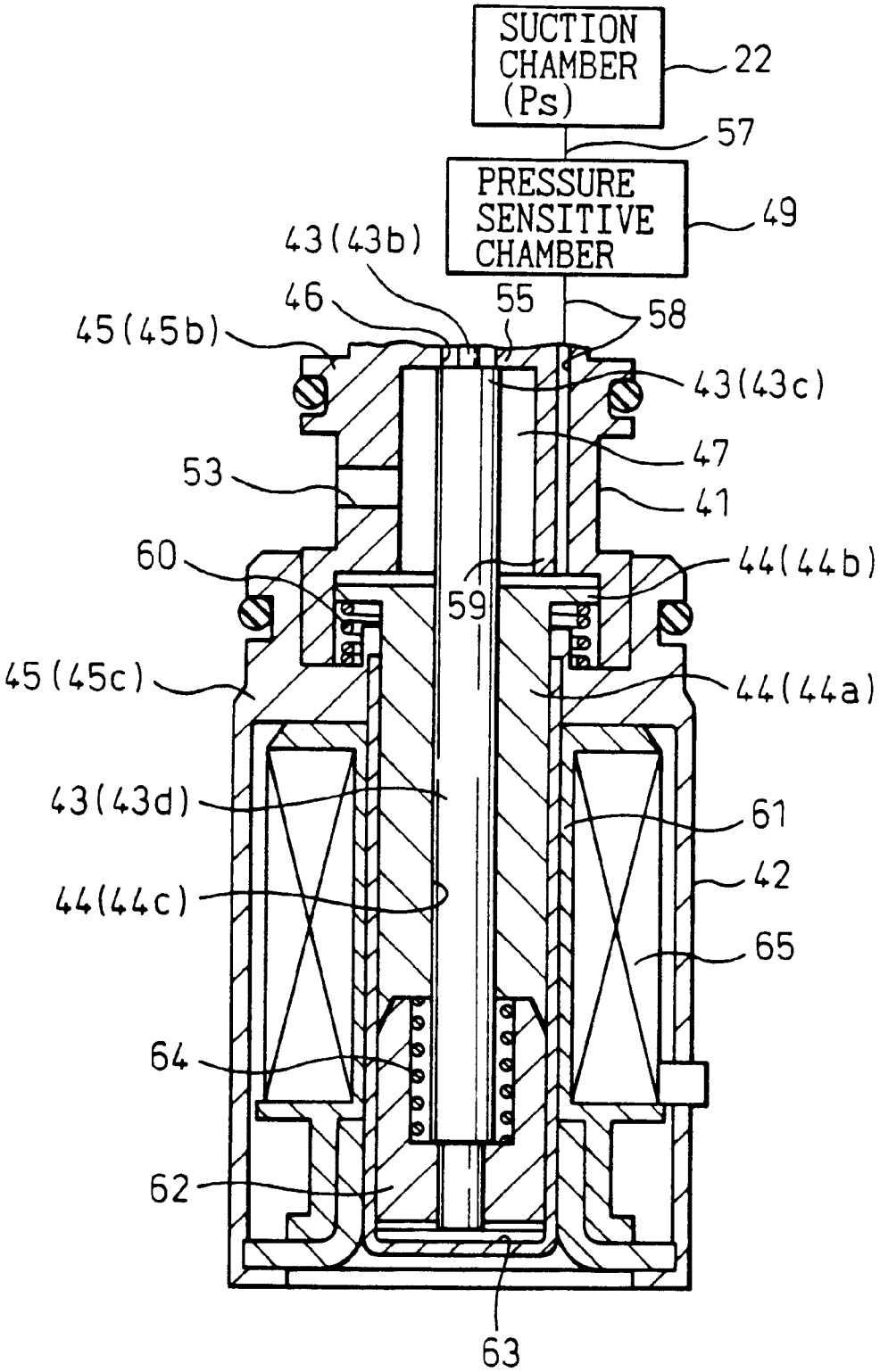
FIG. 4 is a cross-sectional view of the control valve for explaining the operation of the control valve, with the second plunger lifted from its value seat.

Accordingly, S43 (YES) and S45 (Dt(x)←Dt(x)+ΔD) shown in the flow chart of FIG. 6 are repeated, and soon the duty ratio Dt(x) exceeds Dt(1) and the setting suction pressure Y(x) becomes lower than Y(1). Accordingly, as shown in FIG. 4, the second plunger 44 leaves the uppermost position, and the second valve section 44*b* opens the second communicating passage 58 (the second extraction passage 32), and therefore, the refrigerant extracting capacity for extracting the refrigerant from the crank chamber 15 into the suction chamber 22 is greatly enhanced, while the refrigerant extraction was conducted only by the first extraction passage 31 so far. As a result, the liquid refrigerant in the crank chamber 15 is quickly extracted into the suction chamber 22 via the extraction passages 31 and 32 (in this case, the refrigerant is extracted in the gaseous state or the liquid state), and the liquid refrigerant in the crank chamber 15 can be quickly evaporated. Therefore, the compressor can change its operating condition to the maximum discharge capacity, without causing a long delay from the start of the vehicle air conditioner, that is, the vehicle air conditioner can meet the demand of quick cooling.

The embodiment described above can provide the following effects.

(1) In the electromagnetic structure of the control valve 34, the first plunger 62 and the second plunger 44 can move independently of each other. That is, the relationship between a stationary iron core and a plunger (movable iron core) in the conventional electromagnetic valve is changed, and in the present invention, both iron cores 44 and 62 are movable. Accordingly, it is possible to adopt a structure in which the valve elements 43*c* and 44*b* are operatively associated with the iron cores 44 and 62, respectively, and therefore, it is possible to adjust the degrees of opening of two fluid passages 32 and 33 by one electromagnetic structure (the combination of two iron cores 44 and 62 and one coil 65). As a result, when the structure of this embodiment is compared with two electromagnetic structures which are adopted in order to adjust the degrees of opening of two fluid passages 32 and 33, the one electromagnetic structure for adjusting the degrees of opening of both the passages 32 and 33 of the present invention can be provided at low cost, and further the space in which this structure is installed can be reduced. Due to the foregoing, the manufacturing cost and the size of the variable capacity type compressor can be reduced.

(2) The control valve 34 is provided with the pressure sensitive structure (the bellows 51 and others), the bellows 51 being sensitive to the suction pressure Ps in the refrigerant circulating circuit, and applying the load (S-Ps) based on the suction pressure Ps to the operation rod 43 (the first valve section 43*c*). Accordingly, it is not necessary to provide a complicated structure such as a pressure sensor which electrically detects the suction pressure Ps and reflects it to the electromagnetic attraction force F and a complicated control program for controlling the coil 65 (the drive circuit 72).

(3) The discharge capacity control of the compressor is carried out by changing the inclination angle of the swash plate 18 by adjusting the pressure Pc in the crank chamber 15. The control valve 34 of this embodiment is most suitable for controlling the discharge capacity of the swash plate type variable capacity compressor.

(4) When the duty ratio Dt(x) with respect to the control valve 34 is in the range from Dt(min) to Dt(1), the discharge capacity control of the compressor controls the pressure Pc in the crank chamber 15 by positively adjusting the degree of opening of the supply passage 33, that is, the discharge capacity of the compressor is controlled by inlet side control. Accordingly, this embodiment is advantageous in that the pressure Pc in the crank chamber 15 can be quickly changed and the discharge capacity of the compressor can thus be quickly changed because the high pressure is controlled compared with outlet side control in which the gas extraction into the suction chamber 22 is positively adjusted. Also, when the duty ratio Dt(x) with respect to the control valve 34 is in the range from Dt(1) to Dt(max), the discharge capacity control of the compressor is carried out by positively adjusting the degree of opening of the second extraction passage 32, that is, the discharge capacity of the compressor is controlled by outlet side control. Accordingly, even in an emergency case caused when the liquid refrigerant stays in the crank chamber 15, with which the inlet side control can not cope (that is, even in the case in which the change of the operating condition of the compressor from the minimum discharge capacity state is delayed although quick cooling is demanded), it is possible to appropriately cope with these circumstances. As described above, compared with a case in which only inlet side control or outlet side control is conducted to control the discharge capacity, the performance of the discharge capacity control can be enhanced.

(5) The control valve 34 includes the urging springs 52 and 64 for urging the first plunger 62 away from the second plunger 44, and the urging springs 60 and 64 for urging the second plunger 44 away from the first plunger 62. As the urging force (f1+f2) of the springs 52 and 64 and the urging force (f2+f3) of the springs 60 and 64 are set differently from each other (f3>f1), it is possible to differentiate the electromagnetic attraction force F (duty ratio Dt(x)=Dt(min) to Dt(1)) by which the operation rod 43 (the first plunger 62) starts moving upward from the lowermost position) from the electromagnetic attraction force F (duty ratio Dt(x) exceeds Dt(1)) by which the second plunger 44 starts moving downward from the uppermost position). Accordingly, for example, as shown in this embodiment, it is possible to give such an operation characteristic to the control valve 34 that when duty ratio Dt(x) is changed in the range from Dt(min) to Dt(1) in which the second plunger 44 does not start moving downward, the second extraction passage 32 is held at a constant degree of opening (the fully closed state), and the pressure in the crank chamber 15 can be adjusted only by adjusting the degree of opening of the supply passage 33. As a result, in the case of controlling the discharge capacity in the range of the duty ratio Dt(x) from Dt(min) to Dt(1), it is possible to reduce a quantity of leakage of compressed refrigerant gas via the supply passage 33, the crank chamber 15 and the extraction passages 31 and 32. Therefore, the efficiency of the compressor can be enhanced. Further, it is possible to quickly increase the pressure in the crank chamber 15 and, especially, the discharge capacity control characteristic can be enhanced in the case where the discharge capacity is reduced.

Further, the urging force (f1+f2) of the springs 52 and 64 and the urging force (f2+f3) of the springs 60 and 64 are set so that the second plunger 44 can be moved downward, from the uppermost position, after the operation rod 43 is arranged at the uppermost position and the first valve section 43*c* is seated on the first valve seat 55 or, in other words, after the first plunger 62 is restricted from approaching the second plunger 44. Accordingly, it is possible to give such an operation characteristic to the control valve 34 that when the discharge capacity is controlled in the range of duty ratio Dt(x) from Dt(1) to Dt(max), the supply passage 33 is held at a constant degree of opening (in the fully closed state), and the degree of opening of the second extraction passage 32 can be adjusted. Accordingly, for example, even in an emergency case caused when the liquid refrigerant stays in the crank chamber 15, that is, even in an emergency case in which secession from the minimum discharge capacity state is delayed although quick cooling is demanded, the introduction of high pressure gas from the discharge chamber 23 into the crank chamber 15 via the supply passage 33 can be shut off. Therefore, the pressure reduction in the crank chamber 15 can be more quickly accomplished.

Second Embodiment

This embodiment is similar to the first embodiment, except that the pressure sensitive structure of the control valve 34 detects a pressure difference (Pd−Ps) of the refrigerant between the discharge pressure Pd and the suction pressure Ps, and applies the load based on this pressure difference (Pd−Ps) to the first valve section 43*c* (operation rod 43).

Figure 7:
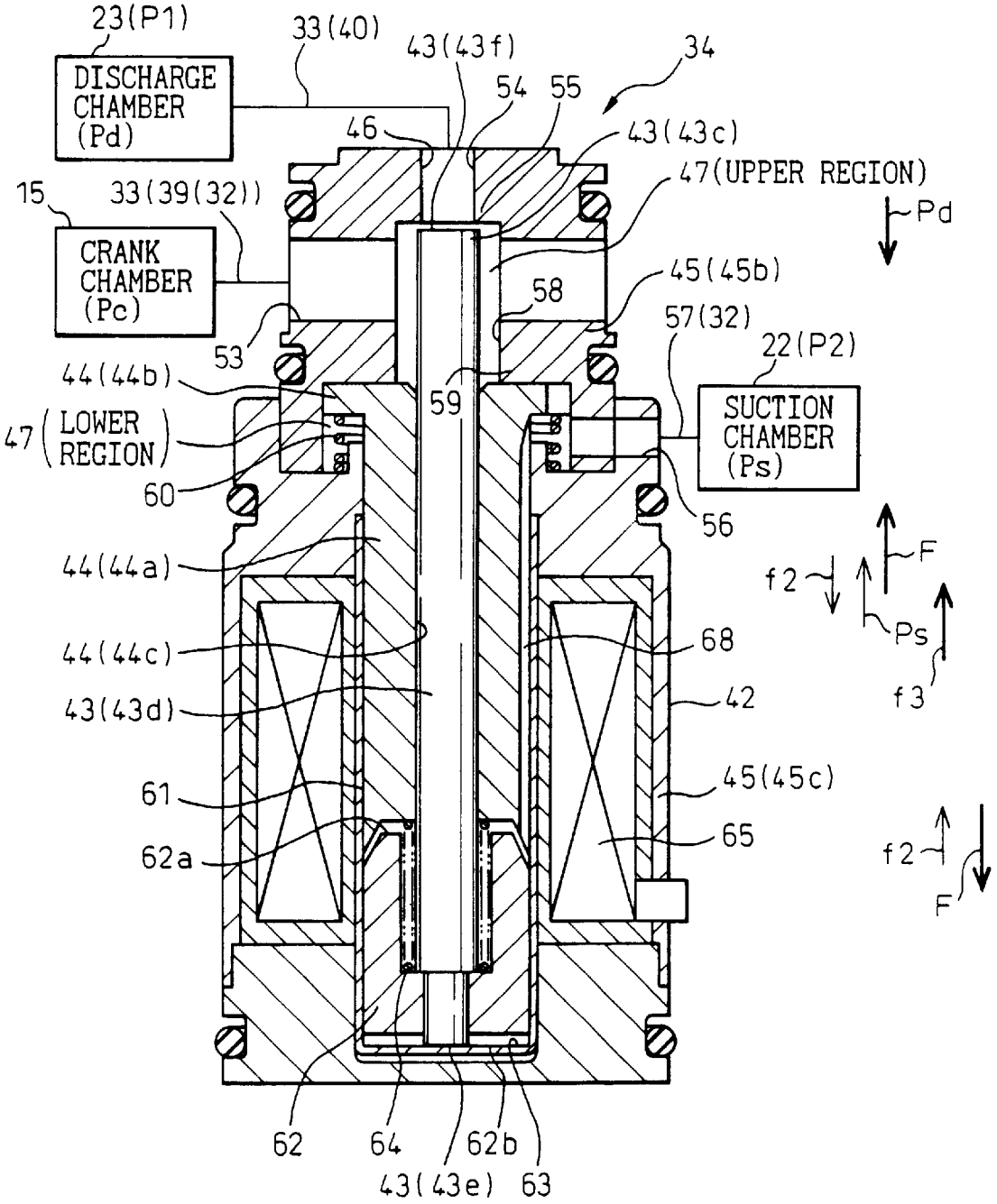
FIG. 7 is a cross-sectional view showing the control valve of the second embodiment.

As shown in FIG. 7, the suction pressure PS in the suction chamber 22, which is the second pressure monitoring point P2, is introduced into the lower region of the valve chamber 47 in the drawing via the pressure detecting passage 57 and the third port 56. In the valve chamber 47, this lower region is connected to the upper region, into which the pressure Pc in the crank chamber 15 is introduced via the first port 53 and the first passage 39, via the second communicating passage 58, which can be referred to as an intermediate region in the valve chamber 47, located between the lower region and the upper region. This second communicating passage 58 is shut off when the second plunger 44 is located at the uppermost position in FIG. 7 and the second valve section 44*b* is seated at the second valve seat 59. Also, this second communicating passage 58 is opened when the second plunger 44 is moved downward from the uppermost position and the second valve section 44*b* leaves the second valve seat 59.

In the valve chamber 47, the lower region, into which the suction pressure Ps is introduced, is connected to the plunger chamber 63 via a passage 68 formed between the second plunger 44 and the accommodation cylinder 61. Accordingly, the suction pressure Ps is introduced into the plunger chamber 63. Suction pressure Ps acts on the upper end surface 62*a*, the lower end surface 62*b* of the first plunger 62, and the lower end surface 43*e* of the operation rod 43 (solenoid rod section 43*d*). In this case, the effective pressure receiving area to receive the suction pressure Ps on the upper end surface 62*a* of the first plunger 62 is smaller than the effective pressure receiving area which is a sum of the lower end surface 62*b* of the first plunger 62 and the lower end surface 43*e* of the solenoid rod 43*d*, the difference corresponding to the transverse cross-sectional area of the solenoid rod 43*d* which penetrates the first plunger 62. Accordingly, from an overall viewpoint, the upward load caused by the suction pressure Ps acts on the first plunger 62 (the operation rod 43). On the other hand, the discharge pressure Pd of the discharge chamber 23, which is the first pressure monitoring point P1, acts on the upper end surface 43f of the operation rod 43 (the first valve section 43*c*) which is opposed to the opening of the first communicating passage 46 via the second port 54 and the first communicating passage 46. Accordingly, a downward load caused by the discharge pressure Pd acts on the operation rod 43.

As described above, the discharge pressure Pd and the suction pressure Ps are related to the arrangement of the operation rod 43, and the operation rod 43 and the first plunger 62, which directly receive both pressures Pd and Ps, constitute a pressure sensitive member. A dynamic relationship of the operation rod 43 can be expressed by the following formula 4. In this connection, the effective pressure receiving area (T) of the discharge pressure Pd of the operation rod 43 is approximately the same as that (T) of the suction pressure Ps of the first plunger 62 and the operation rod 43.

$$(Pd-Ps)T=F-f2 \quad (4)$$

This formula 4 can be transformed into formula 5.

$$Pd-Ps=(F-f2)/T \quad (5)$$

In the control valve 34 of this embodiment, it can be said, from this formula 5, that the setting value (setting pressure difference) of the pressure difference (Pd–Ps) between the discharge pressure Pd and the suction pressure Ps, which is a reference of the motion of the operation rod 43, can be decisively determined from the outside by the duty control conducted on the coil 65.

In more particular, when the duty ratio of the coil 65 is increased so as to increase the electromagnetic attraction force F, the setting pressure difference is increased, and when the duty ratio of the coil 65 is decreased so as to decrease the electromagnetic attraction force F, the setting pressure difference is decreased. That is, when the vertical axis of the graph shown in FIG. 5 is changed to represent a setting pressure difference Y(x) and the characteristic curve is changed into a two-dotted chain line, the graph can express the relationship between the duty ratio Dt(x) (Dt (min) to Dt(max)) and the setting pressure difference Y(x) (Y(min) to Y(max)) in the control valve 34 of this embodiment.

When the discharge capacity of the compressor is changed, the discharge pressure Pd and the suction pressure Ps are changed according to the change in the discharge capacity of the compressor, but the amount of the change in the suction pressure Ps is much smaller than that of the change in the discharge pressure Pd. Accordingly, when the discharge capacity of the compressor is increased, the discharge pressure Pd is raised, and thus the pressure difference between the discharge pressure Pd and the suction pressure Ps is increased. On the contrary, when the discharge capacity of the compressor is decreased, the discharge pressure Pd is lowered, and the pressure difference between the discharge pressure Pd and the suction pressure Ps is decreased. That is, the discharge capacity of the compressor is reflected on the pressure difference (Pd–Ps) between the discharge pressure Pd and the suction pressure Ps, and therefore, when the duty ratio Dt(x) of the coil 65 is changed so as to change the setting pressure difference Y(x), the discharge capacity of the compressor can be changed. As a result, the duty ratio Dt(x) can be corrected in a similar manner to that shown in the flow chart of FIG. 6, the duty ratio Dt(x) is gradually optimized even if the detected temperature Te(t) is deviated from the setting temperature Te(set) and, further, the degree of opening of the control valve 34 is autonomously adjusted according to the refrigerant pressure difference (Pd–Ps) (the setting pressure difference Y(x) is maintained), whereby the temperature Te(t) converges to a value close to the setting temperature Te(set).

In this embodiment, the same effects as those of the first embodiment can be provided.

Third Embodiment

The pressure sensitive structure of the control valve 34 in the second embodiment is such that the pressure difference (Pd–Ps) between the discharge pressure Pd of the discharge chamber 23, which is the first pressure monitoring point P1, and the suction pressure Ps of the suction chamber 22, which is the second pressure monitoring point P2, is detected, and the load caused by this pressure difference (Pd–Ps) is given to the first valve section 43*c* (the operation rod 43). That is, the pressure sensitive structure of the control valve 34 is arranged such that in order to detect this refrigerant pressure difference (Pd–Ps), in the refrigerant circuit, the first pressure monitoring point P1 is set in the discharge pressure region (the region between the discharge chamber 23 of the compressor and the condenser 36), and the second pressure monitoring point P2 is set in the suction pressure region (the region between the evaporator 38 and the suction chamber 22 of the compressor).

Figure 8:
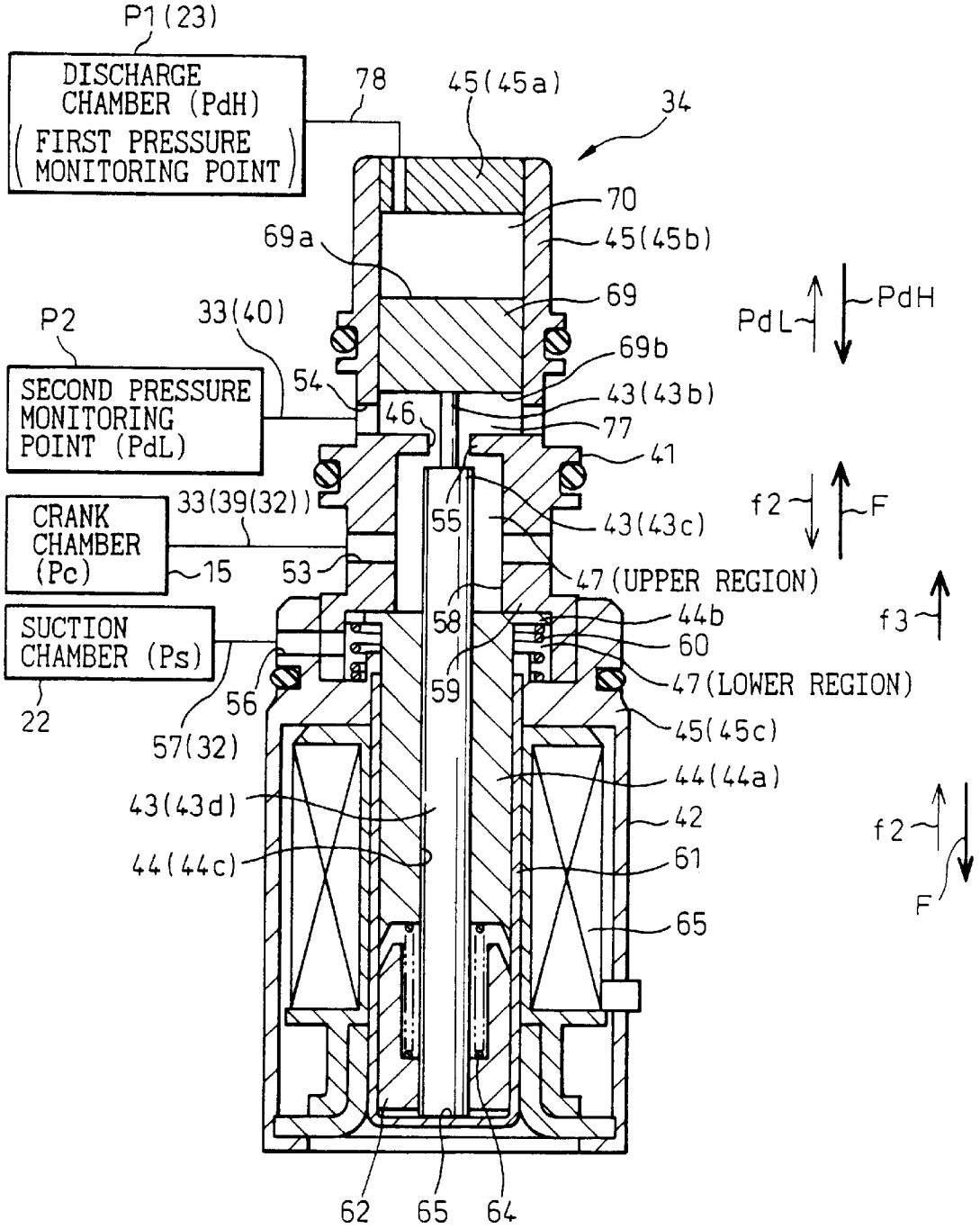
FIG. 8 is a cross-sectional view showing the control valve of the third embodiment.
Figure 9:
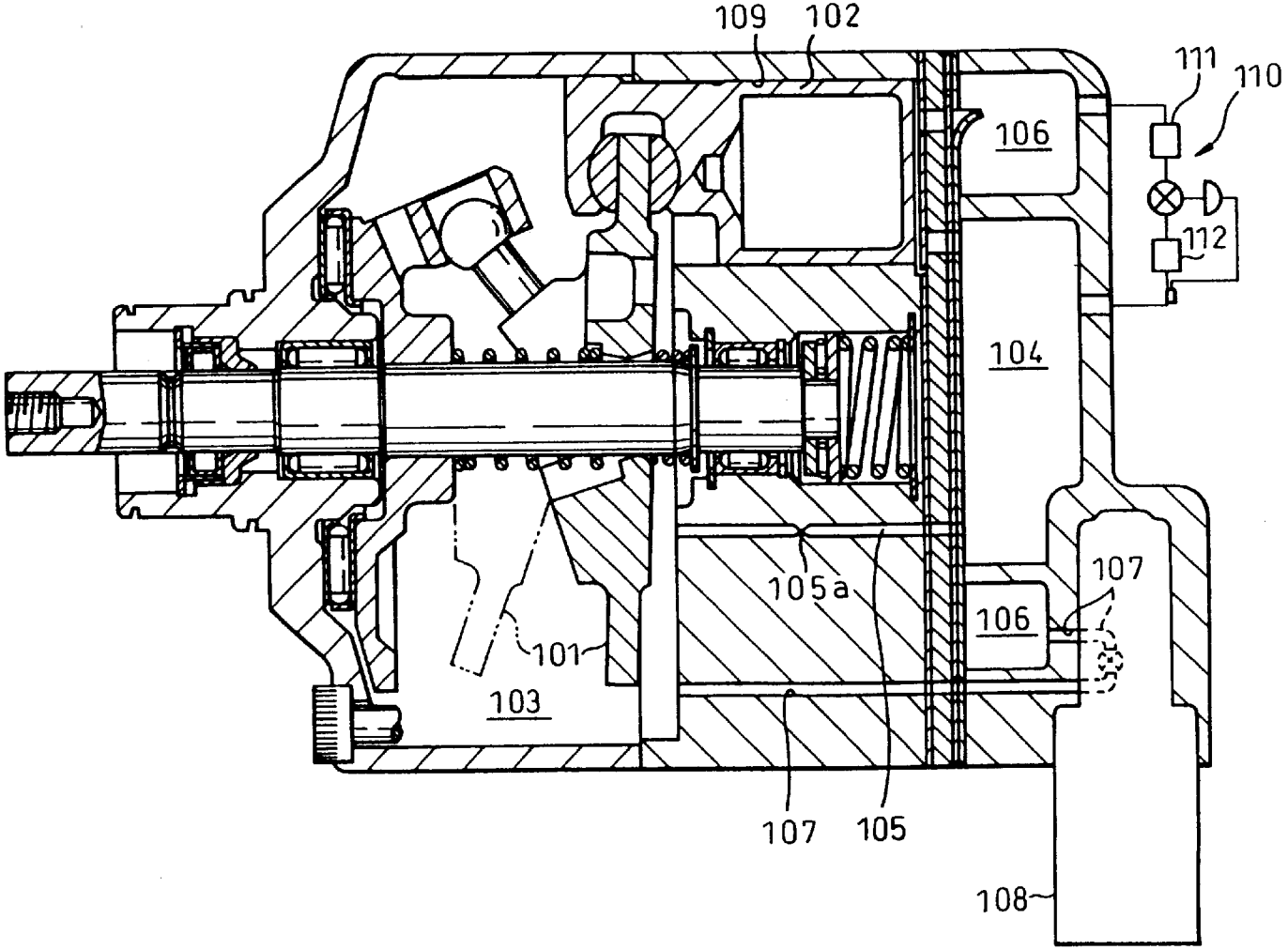
FIG. 9 is a cross-sectional view showing a conventional variable capacity type swash plate type compressor.

In the third embodiment, the pressure sensitive structure is changed. As shown in FIGS. 1 and 8, the second pressure monitoring point P2 is set (in the piping of the external refrigerant circuit 35) on the downstream side which is on the lower pressure side than the first pressure monitoring point P1 (the discharge chamber 23) in the discharge pressure region. Due to the foregoing, the pressure sensitive structure is arranged such that the load according to the pressure difference (PdH–PdL) between the pressure PdH at the first pressure monitoring point P1 and the pressure PdL at the second pressure monitoring point P2 is given to the first valve section 43*c* (the operation rod 43).

The pressure sensitive structure of the control valve 34 of this embodiment thus includes a movable wall 69 which is a pressure sensitive member for detecting the pressure difference (PdH–PdL), a P1 pressure chamber 70 into which the pressure PdH at the first pressure monitoring point P1 is introduced via a P1 passage 78, and a P2 pressure chamber 77 into which the pressure PdL at the second pressure monitoring point P2 is introduced, the P2 pressure chamber 77 being arranged adjacent to the P1 pressure chamber 70 via the movable wall 69 and below the chamber 70 in the drawing. The movable wall 69 is movable in the upper portion of the valve housing 45 in the upward and downward directions in the drawing and shuts off the communication of the P1 pressure chamber 70 with the P2 pressure chamber 77. The movable wall 69 is connected to the operation rod 43 via the first communicating passage 46 and the connecting section 43*b* inserted into the P2 pressure chamber 77. The P2 pressure chamber 77 is communicated with the valve chamber 47 via the first communicating passage 46 and also communicated with the second pressure monitoring point P2 via the second port 54, which is a P2 passage, and also via the second passage 40. Accordingly, the P2 pressure chamber 77 constitutes a portion of the supply passage 33. That is, in this embodiment, the P2 pressure PdL at the second pressure monitoring point P2 is used for adjusting the pressure in the crank chamber 15. In this connection, in the second embodiment, the P1 pressure PdH at the first pressure monitoring point P1 (the discharge chamber 23) is used for adjusting the pressure in the crank chamber 15.

Accordingly, the pressure PdH in the P1 pressure chamber 70 acts on the upper end surface 69*a* on the movable wall 69, and the pressure PdL in the P2 pressure chamber 77 acts on the lower end surface 69*b*. Accordingly, from an overall point of view, the load, which is directed downward and caused by the pressure difference between the pressure PdH and the pressure PdL, acts on the movable wall 69 (the operation rod 43). In this case, the effective pressure receiving area of the lower end surface 69*b* of the movable wall 69 is a little smaller than the effective pressure receiving area of the upper end surface 69*a* by the cross-sectional area of the connecting section 43*b* connected to the lower end surface 69*b* of the movable wall 69. However, the cross-sectional area of the connecting section 43*b* is very small, and therefore, in this embodiment, it can be considered that an influence given by the connecting section 43*b* is negligibly small. Accordingly, it can be assumed that the effective pressure receiving areas of the upper end surface 69*a* and the lower end surface 69*b* of the movable wall 69 are substantially the same (U). Consequently, the dynamic relationship of the arrangement of the operation rod 43 can be expressed by the following formula 6.

$$(PdH-PdL)U=F-f2 \quad (6)$$

This formula 6 is transformed into the formula 7.

$$PdH-PdL=(F-f2)/U \quad (7)$$

According to the formula 7, in the control valve 34 of this embodiment, a setting value (setting difference) of the pressure difference (PdH−PdL) between the pressure PdH and the pressure PdL, which is a reference of the motion of the operation rod 43, can be decisively determined from the outside by the duty control of the coil 65.

In more detail, when the duty ratio Dt(x) of the coil 65 is increased and the electromagnetic force F is increased, the setting pressure difference is increased. on the contrary, when the duty ratio Dt(x) of the coil 65 is decreased and the electromagnetic force F is decreased, the setting pressure difference is decreased. That is, when the vertical axis of the graph shown in FIG. 5 is changed to represent a setting pressure difference Y(x) and the characteristic curve is changed into a two-dotted chain line, the graph can express the relationship between the duty ratio Dt(x) (Dt(min) to Dt(max)) and the setting pressure difference Y(x) (Y(min) to Y(max)) in the control valve 34 of this embodiment.

In this case, when the discharge capacity of the compressor is increased, the flow rate of refrigerant in the discharge region in the refrigerant circulating circuit is increased. Therefore, a pressure loss according to the pipe line resistance in the discharge pressure region is increased, that is, the pressure difference (PdH−PdL) between the pressure PdH and the pressure PdL is increased. On the contrary, when the discharge capacity of the compressor is decreased, the flow rate of refrigerant in the discharge region in the refrigerant circulating circuit is decreased. Therefore, the pressure difference (PdH−PdL) between the pressure PdH and the pressure PdL is decreased. The discharge capacity of the compressor is reflected on the pressure difference (PdH−PdL) between the pressure PdH and the pressure PdL. Therefore, when the duty ratio Dt(x) of the coil 65 is changed so as to change the setting pressure difference Y(x), the discharge capacity of the compressor can be changed. As a result, the duty ratio Dt(x) is corrected in the similar manner to that shown in the flow chart of FIG. 6, even if the detecting temperature Te(t) is different from the setting temperature Te(set), the duty ratio Dt(x) is gradually optimized, and further the degree of opening of the control valve 34 is autonomously adjusted according to the refrigerant pressure difference (PdH−PdL), that is, the setting pressure difference Y(x) is maintained. Therefore, the temperature Te(t) converges to a value close to the setting temperature Te(set).

In this embodiment, the same effects as those of the first embodiment can be provided.

In this connection, the following embodiments can be adopted without departing from the spirit and scope of the present invention.

The first pressure monitoring point is set in the suction pressure region, and the second pressure monitoring point is set in the same suction pressure region on the downstream side which is on the lower pressure side than the first pressure monitoring point. According to the pressure difference between the first pressure monitoring point and the second pressure monitoring point, the pressure sensitive structure gives the load to the first valve section 43*c* (the operation rod 43), that is, according to the pressure loss caused by the pipe line resistance in the suction pressure region in the refrigerant circulating circuit, the pressure sensitive structure gives the load to the first valve section 43*c* (the operation rod 43).

In each embodiment described above, there is provided a region in which the urging force of each spring 52, 60 or 64 is adjusted so that only the second valve section 44*b* (the second plunger 44) or both the second valve section 44*b* and the first valve section 43*c* (the operation rod 43) are operated by the change in the load of the pressure sensitive structure caused by the refrigerant pressure or difference in the refrigerant pressure.

The present invention can be embodied in a control valve of a wobble-type variable capacity compressor.

The fluid circuit is not limited to a refrigerant circulating circuit, but can be applied to a hydraulic circuit and a pneumatic circuit. The present invention is embodied as a control valve applied to the above circuits. Also the present invention can be embodied in a rotary machine into which the control valve is incorporated.

In each embodiment described above, the first and second fluid passages can be said to be auxiliary circuits (circuits for controlling the discharge capacity of a compressor which is arranged in a primary refrigerant circulating circuit).

However, the present invention is not limited to the above specific embodiment, but the first and the second fluid passages may compose a primary circuit (refrigerant circulating circuit) of a fluid circuit, and the control valve may adjust the degree of opening of this primary circuit.

According to the present invention described above, compared with a conventional structure in which two electromagnetic structures are required for adjusting the degrees of opening of two fluid paths, it is possible to provide a compact control valve structure at low manufacturing cost. Therefore, it is possible to provide a compact variable capacity compressor at low manufacturing cost.

What is claimed is:

1. A control valve comprising:

a valve housing having first and second fluid passages;

independently movable first and second plungers arranged in the valve housing;

a magnetic flux generating device generating a magnetic flux according to a supplied electric power to provide an electromagnetic attraction force acting on and between said first and second plungers;

a first valve element connected to the first plunger for adjusting the degree of opening of said first fluid passage; and a second valve element connected to the second plunger for adjusting the degree of opening of said second fluid passage.

2. A control valve comprising:

a valve housing having first and second fluid passages;

independently movable first and second plungers arranged in the valve housing;

a magnetic flux generating device generating a magnetic flux according to a supplied electric power to provide an electromagnetic attraction force acting on and between said first and second plungers;

a first valve element connected to the first plunger for adjusting the degree of opening of said first fluid passage; and a second valve element connected to the second plunger for adjusting the degree of opening of said second fluid passage;

wherein a pressure sensitive structure is provided for giving a load to at least one of the first and second valve elements according to a fluid pressure or a fluid pressure difference in a fluid circuit in which said control valve is arranged.

3. A control valve according to claim 2, further comprising:

a first urging means urging the first plunger away from the second plunger; and a second urging means urging the second plunger away from the first plunger;

wherein the urging force of the first urging means is different from the urging force of the second urging means, so that the start of movement of the first plunger toward the second plunger against the urging force of the first urging means occurs separately from the start of the movement of the second plunger to the first plunger against the urging force of the second urging means according to the magnetic attraction force.

4. A control valve according to claim 3, wherein the urging force of the first urging means is lower than the urging force of the second urging means;

the control valve includes a first plunger movement restricting means for restricting the movement of the first plunger to approach the second plunger; and according to an increase in the electromagnetic force, the first plunger first moves toward the second plunger to a position restricted by the first plunger movement restricting means against the urging force of the first urging means, and the second plunger then moves toward the first plunger against the urging force of the second urging means.

5. A control valve comprising:

a valve housing having first and second fluid passages;

independently movable first and second plungers arranged in the valve housing;

a magnetic flux generating device generating a magnetic flux according to a supplied electric power to provide an electromagnetic attraction force acting on and between said first and second plungers;

a first valve element connected to the first plunger for adjusting the degree of opening of said first fluid passage; and a second valve element connected to the second plunger for adjusting the degree of opening of said second fluid passage;

wherein said first and second plungers are coaxially arranged, and said magnetic flux generating device surrounds said first and second plungers.

6. A variable capacity type compressor constituting a refrigerant circulating circuit of an air conditioner, said compressor comprising:

a housing having a suction chamber, a discharge chamber, compression chambers, and a control chamber, said control chamber being in fluid communication with said suction chamber and said discharge chamber;

a refrigerant compressing mechanism for sucking a refrigerant from said suction chamber into said compression chambers and discharging the compressed refrigerant from said compression chambers into said discharge chamber, said refrigerant compressing mechanism being arranged such that the capacity of the compressor is varied by changing a pressure in the control chamber; and a control valve for controlling the pressure in the control chamber;

said control valve comprising:

a valve housing having first and second fluid passages;

independently movable first and second plungers arranged in the valve housing;

a magnetic flux generating device generating a magnetic flux according to a supplied electric power to provide electromagnetic attraction force acting on and between said first and second plungers;

a first valve element connected to the first plunger for adjusting the degree of opening of said first fluid passage; and a second valve element connected to the second plunger for adjusting the degree of opening of said second fluid passage.

7. A variable capacity type compressor according to claim 6, wherein said housing has cylinder bores constituting said compression chambers; and wherein said refrigerant compressing mechanism comprises:

pistons reciprocatingly arranged in said cylinder bores;

a drive shaft passing through said control chamber;

a rotation member fixed to said drive shaft for rotation therewith; and a cam plate arranged in said control chamber and rotatably and tiltably mounted to said drive shaft, said cam plate being operatively connected to said rotation member so that said cam plate can be rotated by said drive shaft via said rotation member, said cam plate being operatively connected to said pistons so that the rotation of said cam plate is converted into reciprocating motion of said pistons.

8. A variable capacity type compressor according to claim 7, wherein said first and second plungers are coaxially arranged, and said magnetic flux generating device surrounds said first and second plungers.

9. A variable capacity type compressor according to claim 6, wherein the first fluid passage connects the control chamber to a suction pressure region, the second fluid passage connects the control chamber to a discharge pressure region.

10. A variable capacity compressor according to claim 6, wherein the first fluid passage connects the control chamber to a discharge pressure region, and the second fluid passage connects the control chamber to a suction pressure region.

11. A variable capacity type compressor according to claim 6, wherein said housing has a first passage extending between said control chamber and said suction chamber and a second passage extending between said control chamber and said control valve; and wherein said first fluid passage of said control valve is connected, on one hand, to said second passage and, on the other hand, to said discharge chamber, and said second fluid passage of said control valve is connected, on one hand, to said second passage and, on the other hand, to said suction chamber.

12. A variable capacity type compressor according to claim 11, wherein said first valve element is movable to change the degree of opening of said first fluid passage while said second valve element closes said second fluid passage, and said second valve element is movable to open said second fluid passage after said first valve element closes said first fluid passage.

13. A variable capacity compressor according to claim 6, wherein the control valve includes a pressure sensitive structure for giving a load to at least one of the first and second valve elements according to a refrigerant pressure or a pressure difference in the refrigerant circulating circuit according.

14. A variable capacity compressor according to claim 13, wherein the pressure sensitive structure is composed in such a manner that the degree of opening of the fluid passage is adjusted by at least one of the first and the second valve element so that the refrigerant pressure or the pressure difference in the refrigerant circulating circuit, which is set by an electromagnetic attraction force, can be maintained.

15. A variable capacity compressor according to claim 14, wherein the pressure sensitive structure is composed in such a manner that a load caused by the refrigerant pressure in the suction pressure region is given to at least one of the first and the second valve elements.

16. A variable capacity compressor according to claim 14, wherein the pressure sensitive structure is composed in such a manner that a load caused by a difference between the refrigerant pressure at a first pressure monitoring point and the refrigerant pressure at a second pressure monitoring point which is on the downstream or lower pressure side of the first pressure monitoring point in the refrigerant circulating circuit is given to at least one of the first and the second valve elements.

17. A variable capacity compressor according to claim 6, further comprising:

a first urging means urging the first plunger away from the second plunger; and a second urging means urging the second plunger away from the first plunger;

wherein the urging force of the first urging means is different from force of the second urging means so that the start of movement of the first plunger toward the second plunger against the urging force of the first urging means, occurs separately from the start of movement of the second plunger toward the first plunger against the urging force of the second urging means.

18. A variable capacity compressor according to claim 17, wherein the urging force of the first urging means is lower than the urging force of the second urging means;

the control valve includes a first plunger movement restricting means for restricting a movement of the first plunger to approach the second plunger; and according to an increase in the electromagnetic force, the first plunger first moves toward the second plunger to a position restricted by the first plunger movement restricting means against the urging force of the first urging means, and the second plunger then moves toward the first plunger against the urging force of the second urging means.

19. A variable capacity type compressor according to claim 16, wherein the pressure sensitive structure is composed in such a manner that a load caused by a difference between the pressure at the first pressure monitoring point, which is in a discharge pressure region between the discharge chamber and a condenser in the refrigerant circulating circuit, and the pressure at the second pressure monitoring point, which is in a suction pressure region between an evaporator and the suction chamber, is given to at least one of the first and second valve elements.

20. A variable capacity compressor according to claim 16, wherein the pressure sensitive structure is composed in such a manner that a load caused by a difference between the pressure at the first pressure monitoring point, which is in a discharge pressure region between the discharge chamber and a condenser in the refrigerant circulating circuit, and the pressure at the second pressure monitoring point, which is on the downstream side or the lower pressure side of the first pressure monitoring point in the discharge pressure region, is given to at least one of the first and second valve elements.

21. A variable capacity compressor according to claim 16, wherein the pressure sensitive structure is composed in such a manner that a load caused by a difference between the pressure at the first pressure monitoring point, which is in a suction pressure region between an evaporator and the suction chamber in the refrigerant circulating circuit, and the pressure at the second pressure monitoring point, which is on the downstream side or the lower pressure side of the first pressure monitoring point in the suction pressure region, is given to at least one of the first and second valve elements.

* * * * *